US008999904B2

(12) United States Patent
Matsui et al.

(10) Patent No.: US 8,999,904 B2
(45) **Date of Patent: *Apr. 7, 2015**

(54) LUBRICANT OIL COMPOSITION AND METHOD FOR MAKING THE SAME

(75) Inventors: Shigeki Matsui, Tokyo (JP); Akira Yaguchi, Tokyo (JP); Reiko Kudo, Tokyo (JP); Hiroya Miyamoto, Tokyo (JP); Teppei Tsujimoto, Tokyo (JP)

(73) Assignee: JX Nippon Oil & Energy Corporation, Tokyo (JP)

( * ) Notice: Subject to any disclaimer, the term of this patent is extended or adjusted under 35 U.S.C. 154(b) by 527 days.

This patent is subject to a terminal disclaimer.

(21) Appl. No.: 13/375,365

(22) PCT Filed: Jan. 25, 2010

(86) PCT No.: PCT/JP2010/050916

§ 371 (c)(1),
(2), (4) Date: Feb. 21, 2012

(87) PCT Pub. No.: WO2010/140391

PCT Pub. Date: Dec. 9, 2010

(65) Prior Publication Data

US 2012/0135900 A1 May 31, 2012

(30) Foreign Application Priority Data

Jun. 4, 2009 (JP) ..... P2009-135366
Jun. 4, 2009 (JP) ..... P2009-135369

(51) Int. Cl.
*C10M 163/00* (2006.01)
*C10M 145/14* (2006.01)
*C10M 169/04* (2006.01)

(52) U.S. Cl.
CPC ..... *C10M 169/044* (2013.01); *C10M 169/041* (2013.01); *C10M 2203/1006* (2013.01); *C10M 2203/1025* (2013.01); *C10M 2203/1065* (2013.01); *C10M 2205/173* (2013.01); *C10M 2207/262* (2013.01); *C10M 2207/289* (2013.01); *C10M 2209/084* (2013.01); *C10M 2215/102* (2013.01); *C10M 2215/28* (2013.01); *C10M 2217/023* (2013.01); *C10M 2219/068* (2013.01); *C10M 2223/04* (2013.01); *C10N 2220/021* (2013.01); *C10N 2220/022* (2013.01); *C10N 2220/023* (2013.01); *C10N 2220/024* (2013.01); *C10N 2220/025* (2013.01); *C10N 2220/031* (2013.01); *C10N 2220/032* (2013.01); *C10N 2220/033* (2013.01); *C10N 2230/02* (2013.01); *C10N 2230/06* (2013.01); *C10N 2230/74* (2013.01); *C10N 2240/10* (2013.01)

(58) Field of Classification Search
CPC ..... C10M 145/14; C10M 171/02
USPC ..... 508/469, 364
See application file for complete search history.

(56) References Cited

U.S. PATENT DOCUMENTS

| | | | | |
|---|---|---|---|---|
| 2,861,941 | A | 11/1958 | Jancosek et al. | |
| 2,890,161 | A | 6/1959 | Brown et al. | |
| 3,078,222 | A | 2/1963 | Henke et al. | |
| 3,847,790 | A | 11/1974 | Putz | |
| 4,021,357 | A | 5/1977 | Morduchowitz et al. | |
| 4,867,894 | A | 9/1989 | Pennewiss et al. | |
| 5,282,958 | A | 2/1994 | Santilli et al. | |
| 5,362,378 | A | 11/1994 | Borghard et al. | |
| 5,652,201 | A | 7/1997 | Papay et al. | |
| 5,763,374 | A | 6/1998 | Sakai et al. | |
| 5,955,405 | A | 9/1999 | Liesen et al. | |
| 6,077,455 | A | 6/2000 | Bloch et al. | |
| 6,090,989 | A | 7/2000 | Trewella et al. | |
| 6,383,366 | B1 | 5/2002 | Riley et al. | |
| 6,602,402 | B1 | 8/2003 | Benazzi et al. | |
| 7,285,206 | B2 | 10/2007 | Germaine | |
| 7,867,957 | B2 | 1/2011 | Matsui et al. | |
| 2001/0056044 | A1 | 12/2001 | Kinker et al. | |
| 2002/0119896 | A1 | 8/2002 | Yagishita et al. | |
| 2003/0036488 | A1 | 2/2003 | Yuki et al. | |
| 2003/0104955 | A1* | 6/2003 | Yuki et al. | 508/469 |
| 2003/0162673 | A1 | 8/2003 | Kurihara et al. | |

(Continued)

FOREIGN PATENT DOCUMENTS

| | | |
|---|---|---|
| CA | 2 682 660 | 10/2008 |
| CN | 1279708 | 1/2001 |

(Continued)

OTHER PUBLICATIONS

Office Action issued with respect to Chinese Patent Application No. 200980110123.8, mailed Apr. 1, 2013.

(Continued)

*Primary Examiner* — Prem C Singh
*Assistant Examiner* — Francis C Campanell
(74) *Attorney, Agent, or Firm* — Greenblum & Bernstein, P.L.C.

(57) ABSTRACT

The lubricating oil composition of the invention comprises a lubricating base oil with a kinematic viscosity at 100° C. of 1-20 $mm^2/s$, and a viscosity index improver having a ratio M1/M2 of 0.20 or greater, between the total area of the peaks between chemical shifts of 36-38 ppm M1 and the total area of the peaks between chemical shifts of 64-66 ppm M2, with respect to the total area of all of the peaks, in the spectrum obtained by $^{13}C$-NMR. The lubricating oil composition of the invention has excellent effects, with a sufficiently high HTHS viscosity at 150° C., and a sufficiently low kinematic viscosity at 40° C., a sufficiently low kinematic viscosity at 100° C. and a sufficiently low HTHS viscosity at 100° C.

8 Claims, No Drawings

(56) References Cited

U.S. PATENT DOCUMENTS

| | | | | |
|---|---|---|---|---|
| 2003/0226785 | A1 | 12/2003 | Murphy et al. | |
| 2004/0045868 | A1 | 3/2004 | Germaine | |
| 2004/0065588 | A1 | 4/2004 | Genetti et al. | |
| 2004/0077509 | A1 | 4/2004 | Yuki et al. | |
| 2004/0079675 | A1 | 4/2004 | Germaine et al. | |
| 2004/0092409 | A1 | 5/2004 | Liesen | |
| 2004/0099571 | A1 | 5/2004 | Germaine et al. | |
| 2004/0108249 | A1 | 6/2004 | Cody et al. | |
| 2004/0112792 | A1 | 6/2004 | Murphy et al. | |
| 2004/0119046 | A1 | 6/2004 | Carey et al. | |
| 2004/0129603 | A1 | 7/2004 | Fyfe et al. | |
| 2004/0154957 | A1 | 8/2004 | Keeney et al. | |
| 2004/0154958 | A1 | 8/2004 | Alexander et al. | |
| 2004/0198616 | A1 | 10/2004 | Hirao et al. | |
| 2004/0224860 | A1 | 11/2004 | Baba et al. | |
| 2005/0077209 | A1 | 4/2005 | Miller et al. | |
| 2005/0221998 | A1 | 10/2005 | Marumo et al. | |
| 2006/0027486 | A1 | 2/2006 | Rosenbaum et al. | |
| 2006/0052252 | A1 | 3/2006 | Wedlock | |
| 2006/0172900 | A1 | 8/2006 | Yagishita et al. | |
| 2006/0205610 | A1 | 9/2006 | Rosenbaum et al. | |
| 2007/0032392 | A1 | 2/2007 | Yokoyama et al. | |
| 2007/0087947 | A1* | 4/2007 | Glasgow et al. | 508/465 |
| 2007/0138032 | A1 | 6/2007 | Agarkov | |
| 2007/0138052 | A1 | 6/2007 | Kobayashi et al. | |
| 2007/0191239 | A1 | 8/2007 | Matsuoka et al. | |
| 2007/0238627 | A1 | 10/2007 | Haire et al. | |
| 2007/0287643 | A1 | 12/2007 | Matsui et al. | |
| 2008/0015400 | A1 | 1/2008 | Matsui et al. | |
| 2008/0029430 | A1 | 2/2008 | Loh et al. | |
| 2008/0029431 | A1 | 2/2008 | Alexander et al. | |
| 2008/0110799 | A1 | 5/2008 | Matsui et al. | |
| 2008/0248981 | A1 | 10/2008 | Matsui et al. | |
| 2009/0005278 | A1 | 1/2009 | Takeuchi et al. | |
| 2009/0075852 | A1 | 3/2009 | Yagishita et al. | |
| 2009/0221461 | A1 | 9/2009 | Visger et al. | |
| 2009/0312208 | A1 | 12/2009 | Ishikawa et al. | |
| 2010/0016195 | A1 | 1/2010 | Shirahama et al. | |
| 2010/0035777 | A1 | 2/2010 | Sano et al. | |
| 2010/0041572 | A1 | 2/2010 | Sano et al. | |
| 2010/0093578 | A1 | 4/2010 | Tsujimoto et al. | |
| 2010/0130395 | A1 | 5/2010 | Tagawa et al. | |
| 2010/0144571 | A1 | 6/2010 | Shirahama et al. | |
| 2010/0190671 | A1 | 7/2010 | Stoehr et al. | |
| 2011/0003725 | A1 | 1/2011 | Matsui et al. | |
| 2011/0021394 | A1 | 1/2011 | Nakao et al. | |
| 2011/0042267 | A1 | 2/2011 | Hayasaka | |
| 2011/0049008 | A1 | 3/2011 | Tagawa et al. | |
| 2011/0049009 | A1 | 3/2011 | Tagawa et al. | |
| 2011/0053815 | A1 | 3/2011 | Matsui et al. | |
| 2011/0065618 | A1 | 3/2011 | Tagawa | |
| 2011/0124536 | A1 | 5/2011 | Matsui | |
| 2011/0218131 | A1 | 9/2011 | Tsujimoto et al. | |
| 2011/0230685 | A1 | 9/2011 | Tagawa | |
| 2011/0237477 | A1 | 9/2011 | Tagawa et al. | |
| 2011/0306530 | A1 | 12/2011 | Manabe et al. | |
| 2012/0071373 | A1 | 3/2012 | Matsui et al. | |
| 2012/0071374 | A1 | 3/2012 | Yaguchi et al. | |
| 2012/0071375 | A1 | 3/2012 | Yaguchi et al. | |

FOREIGN PATENT DOCUMENTS

| | | | |
|---|---|---|---|
| CN | 1751115 | | 3/2006 |
| CN | 1317368 | C | 5/2007 |
| CN | 101065469 | | 10/2007 |
| CN | 101213277 | | 7/2008 |
| CN | 101426879 | | 5/2009 |
| EP | 1 798 278 | | 10/2006 |
| EP | 1 749 876 | | 2/2007 |
| EP | 1 808 476 | | 7/2007 |
| EP | 1 845 151 | | 10/2007 |
| EP | 2 011 855 | | 8/2008 |
| EP | 2 009 074 | | 12/2008 |
| EP | 2 009 704 | | 12/2008 |
| EP | 2 011 854 | | 1/2009 |
| EP | 2 251 402 | | 1/2009 |
| EP | 2 112 217 | | 10/2009 |
| EP | 2135928 | | 12/2009 |
| EP | 2 241 611 | | 10/2010 |
| EP | 2264131 | | 12/2010 |
| EP | 2264133 | | 12/2010 |
| EP | 2 319 908 | | 5/2011 |
| GB | 2407100 | | 4/2005 |
| JP | S30-000624 | | 2/1955 |
| JP | S31-003928 | | 5/1956 |
| JP | S45-019183 | | 7/1970 |
| JP | S48-025003 | | 4/1973 |
| JP | 63-223094 | | 9/1988 |
| JP | S63-309592 | | 12/1988 |
| JP | 3-100099 | | 4/1991 |
| JP | 4-30391 | A | 2/1992 |
| JP | 4-036391 | | 2/1992 |
| JP | 4-68082 | A | 3/1992 |
| JP | 4-120193 | A | 4/1992 |
| JP | H5-508876 | | 12/1993 |
| JP | 6-145258 | | 5/1994 |
| JP | 6-306384 | A | 11/1994 |
| JP | 7-048421 | | 2/1995 |
| JP | 7-062372 | | 3/1995 |
| JP | 8-183988 | | 7/1996 |
| JP | 8-302378 | A | 11/1996 |
| JP | 9-003463 | | 1/1997 |
| JP | 2000-063439 | | 2/2000 |
| JP | 2000-63877 | | 2/2000 |
| JP | 2000-345170 | | 12/2000 |
| JP | 2000-345171 | | 12/2000 |
| JP | 2001-514301 | | 9/2001 |
| JP | 2001-279278 | | 10/2001 |
| JP | 2001-279287 | A | 10/2001 |
| JP | 2002-12884 | | 1/2002 |
| JP | 2002-503754 | A | 2/2002 |
| JP | 2002-503755 | | 2/2002 |
| JP | 2002-129182 | A | 5/2002 |
| JP | 2002-521499 | | 7/2002 |
| JP | 2002-220597 | | 8/2002 |
| JP | 2002-302687 | | 10/2002 |
| JP | 2003-292938 | | 10/2003 |
| JP | 2004-10799 | | 1/2004 |
| JP | 2004-124080 | | 4/2004 |
| JP | 2004-169029 | | 6/2004 |
| JP | 2004-526831 | | 9/2004 |
| JP | 2004-528426 | | 9/2004 |
| JP | 2005-154760 | | 6/2005 |
| JP | 2005-154760 | A | 6/2005 |
| JP | 2005-171186 | | 6/2005 |
| JP | 2005-213447 | | 8/2005 |
| JP | 2005-290238 | | 10/2005 |
| JP | 2005-530902 | | 10/2005 |
| JP | 2006-502297 | | 1/2006 |
| JP | 2006-502298 | A | 1/2006 |
| JP | 2006-045277 | | 2/2006 |
| JP | 2006-509899 | | 3/2006 |
| JP | 2006-117851 | A | 5/2006 |
| JP | 2006-117853 | A | 5/2006 |
| JP | 2006-219642 | | 8/2006 |
| JP | 2006-518395 | | 8/2006 |
| JP | 2006-241436 | | 9/2006 |
| JP | 2006-241437 | | 9/2006 |
| JP | 2006-521416 | | 9/2006 |
| JP | 2006-274209 | | 10/2006 |
| JP | 2007-016172 | | 1/2007 |
| JP | 2007-45850 | A | 2/2007 |
| JP | 2007-84826 | | 4/2007 |
| JP | 2007-162026 | | 6/2007 |
| JP | 2007-217494 | | 8/2007 |
| JP | 2007-246659 | | 9/2007 |
| JP | 2007-246661 | | 9/2007 |
| JP | 2007-246662 | A | 9/2007 |
| JP | 2007-262239 | | 10/2007 |
| JP | 2007-269885 | | 10/2007 |
| JP | 2007-270059 | | 10/2007 |
| JP | 2007-270062 | | 10/2007 |
| JP | 2007-284635 | | 11/2007 |

(56) References Cited

FOREIGN PATENT DOCUMENTS

| | | | |
|---|---|---|---|
| JP | 2007-297528 | | 11/2007 |
| JP | 2007-326963 | | 12/2007 |
| JP | 2008-013281 | | 1/2008 |
| JP | 2008-13681 | | 1/2008 |
| JP | 2008-013684 | | 1/2008 |
| JP | 2008-031459 | | 2/2008 |
| JP | 2008-509244 | | 3/2008 |
| JP | 2008-120908 | | 5/2008 |
| JP | 2008-120909 | | 5/2008 |
| JP | 2008-184569 | | 8/2008 |
| JP | 2008-231189 | | 10/2008 |
| JP | 2008-231190 | | 10/2008 |
| JP | 2008-231191 | | 10/2008 |
| JP | 2008-274236 | | 11/2008 |
| JP | 2008-274237 | | 11/2008 |
| JP | 2008-274238 | | 11/2008 |
| JP | 2008-303344 | | 12/2008 |
| JP | 2009-74068 | A | 4/2009 |
| JP | 2009-96925 | | 5/2009 |
| JP | 2009-155639 | | 7/2009 |
| JP | 2009-167278 | | 7/2009 |
| JP | 2009-191247 | | 8/2009 |
| JP | 2010-090250 | | 4/2010 |
| JP | 2010-532805 | | 10/2010 |
| WO | 9603359 | | 2/1996 |
| WO | 99/41334 | | 8/1999 |
| WO | 02/070629 | | 9/2002 |
| WO | 2005/037967 | | 4/2005 |
| WO | 2005/090528 | | 9/2005 |
| WO | 2006/043709 | | 4/2006 |
| WO | 2007/001000 | | 1/2007 |
| WO | 2007/105769 | | 9/2007 |
| WO | 2007/114132 | A1 | 10/2007 |
| WO | 2007/114260 | | 10/2007 |
| WO | 2007/116759 | A1 | 10/2007 |
| WO | 2007/119299 | | 10/2007 |
| WO | 2007/123266 | | 11/2007 |
| WO | 2007/133999 | | 11/2007 |
| WO | 2008/072526 | | 6/2008 |
| WO | 2008/093446 | A1 | 8/2008 |
| WO | 2008/123246 | A1 | 10/2008 |
| WO | 2008/123249 | | 10/2008 |
| WO | 2009/007147 | | 1/2009 |
| WO | 2009/072524 | A1 | 6/2009 |
| WO | 2009/090921 | | 7/2009 |
| WO | 2009/119505 | | 10/2009 |
| WO | 2010/041689 | | 4/2010 |
| WO | 2010/041692 | | 4/2010 |

OTHER PUBLICATIONS

Schiessler et al., "Urea and Thiourea Adduction of $C_5$-$C^{42}$-Hydrocarbons", *Journal of the American Chemical Society*, vol. 74, No. 7, pp. 1720-1723, Apr. 5, 1952.
Notification of Information Provision issued with respect to Japanese Patent App. No. 2008-006024, mailed May 14, 2013.
Japanese Office Action issued with respect to Japanese Patent Application No. 2008-261079, dated May 21, 2013.
"The Advent of Modern Hydroprocessing—The Evolution of Base Oil Technology—Part 2", Machinery Lubirication (Retrieved from http://www.machinerylubrication.com/Read/493/base-oil-technology on May 14, 2012, May 1, 2003, XP55027093.
Search report from E.P.O. that issued with respect to European Patent Application No. 09819126.5, mailed May 23, 2012.
Search report from E.P.O. that issued with respect to European Patent Application No. 09819223.0, mailed May 23, 2012.
Japanese Office Action issued with respect to Japanese Patent Application No. 2008-261070, dated Jul. 2, 2013.
Japanese Office Action issued with respect to Japanese Patent Application No. 2009-135369, dated Jul. 16, 2013.
E.P.O. Office action that issued with respect to European Patent Application No. 09723908.1, mail date is Mar. 2, 2012.
English-language translation of International Preliminary Report on Patentability for PCT/JP2009/067163, mailed May 26, 2011.
English-language translation of International Preliminary Report on Patentability for PCT/JP2009/055667, mailed Nov. 18, 2010.
English-language translation of International Preliminary Report on Patentability for PCT/JP2009/067504, mailed May 26, 2011.
English-language translation of International Preliminary Report on Patentability for PCT/JP2009/067509, mailed May 26, 2011.
English-language translation of International Preliminary Report on Patentability for PCT/JP2010/050921, mailed Jan. 26, 2012.
English-language translation of International Preliminary Report on Patentability for PCT/JP2010/057957, mailed Jan. 26, 2012.
English-language translation of International Preliminary Report on Patentability for PCT/JP2010/059196, mailed Jan. 26, 2012.
International Search Report for PCT/JP2009/067504, mailed Dec. 28, 2009.
International Search Report for PCT/JP2009/055667, mailed Jun. 16, 2009.
International Search Report for PCT/JP2010/050921, mailed Apr. 6, 2010.
International Search Report for PCT/JP2010/057957, mailed Aug. 17, 2010.
J.P.O. Notification of Information Provision issued with respect to Japanese Patent Application No. 2008-078224, mailed May 15, 2012.
E.P.O. Search Report issued with respect to European Patent Application No. 09723908.1, mail date is Jun. 29, 2011.
Sharma et al., "Predicting Low Temperature Lubricant Rheology Using Nuclear Magnetic Resonance Spectroscopy and Mass Spectrometry", Tribology Letters, vol. 16, No. 1-2, Feb. 2004, pp. 11-19.
Shinya Sato et al., "Separation of n-Paraffin and 1-Olefin in Shale Oil by Urea Adduct Method", Sekiyu Gakkaishi, vol. 39, No. 5, 1996, pp. 365-368 with partial English language translation.
English-language translation of International Preliminary Report on Patentability for PCT/JP2009/050233, mailed Jul. 29, 2010.
J.P.O. Notification of Information Provision issued with respect to Japanese Patent Application No. 2008-261070, mailed Jun. 26, 2012.
E.P.O. Search Report issued with respect to European Patent Application No. 09819226.3, mailed Jun. 21, 2012.
J.P.O. Notification of Information Provision issued with respect to Japanese Patent Application No. 2008-078570, mailed May 22, 2012.
E.P.O. Search Report issued with respect to European Patent Application No. 09701700.8, mailed Jul. 5, 2012.
Search Report issued with respect to European Patent Application No. 12002743.8, mailed Aug. 16, 2012.
Search Report issued with respect to European Patent Application No. 12002744.6, mailed Aug. 16, 2012.
Office Action issued with respect to Indonesian Patent Application No. W00201003649, mailed Aug. 23, 2012.
Office Action issued with respect to U.S. Appl. No. 12/812,524, mailed Aug. 28, 2012.
Office Action issued with respect to Chinese Patent Application No. 200980110123.8, mailed Aug. 31, 2012.
Office Action issued with respect to Chinese Patent Application No. 200980110437.8, mailed Aug. 31, 2012.
Office Action issued with respect to European Patent Application No. 09723908.1, mailed Sep. 12, 2012.
Zimmerschied et al., "Crystalline Adducts of Urea with Linear Aliphatic Compounds", Industrial and Engineering Chemistry 42(7), Jul. 31, 1950, pp. 1300-1306.
Rowe et al., "Low-Temperature Performance Advantages for Oils Using Hydrodewaxed Base Stocks", SAE Technical Paper Series 831715, Jan. 1, 1983, pp. 1-14.
Speight, "Hydrocarbons from Petroleum", Handbook of Industrial Hydrocarbon Processes, Jan. 1, 2011, pp. 85-126.
Notification of Information Provision issued with respect to Japanese Patent Application No. 2008-261071, mailed Oct. 9, 2012.
Notification of Information Provision issued with respect to Japanese Patent Application No. 2008-261079, mailed Oct. 9, 2012.
Office Action issued with respect to Chinese Patent Application No. 200980149130.9, mailed Dec. 4, 2012.
Office Action issued with respect to Chinese Patent Application No. 201080024425.6, mailed Dec. 12, 2012.

(56) References Cited

OTHER PUBLICATIONS

Office Action issued with respect to Chinese Patent Application No. 201080024832.7, mailed Dec. 12, 2012.
Search Report issued with respect to European Patent Application No. 10783230.5, mailed Feb. 11, 2013.
Search Report issued with respect to European Patent Application No. 12008549.3, mailed Feb. 11, 2013.
International Search Report for PCT/JP2010/050916, Dated: Apr. 13, 2010.
International Preliminary Report on Patentability for PCT/JP2010/050916, Dated: Jan. 26, 2012.
U.S. Appl. No. 13/322,975 to Matsui et al., filed Nov. 29, 2011.
U.S. Appl. No. 13/375,061 to Yaguchi et al., filed Nov. 29, 2011.
U.S. Appl. No. 13/375,122 to Yaguchi et al., filed Nov. 29, 2011.
Office Action issued with respect to U.S. Appl. No. 13/122,828, mailed Feb. 28, 2013.
Office Action issued with respect to U.S. Appl. No. 12/934,374, mailed Mar. 25, 2013.
Office Action issued with respect to U.S. Appl. No. 13/122,622, mailed Mar. 22, 2013.
Hiroshi Ohtsuka et al., "Separation of Straight—Chain Hydrocarbons from Petroleum Fractions by Means of Urea—Adduct Formation", Bulletin of the Faculty of Engineering, Hokkaido University, 40, Mar. 30, 1966, pp. 125-137, along with a partial English-language translation.
Yozo Oshima et al., "Monomethylparaffins in n-Paraffins Adducted from Petroleum Fractions", Sekiyu Gakkaishi, vol. 18, No. 6, 1975, pp. 497-502, along with a partial English-language translation.
Notification of Information Provision issued with respect to Japanese Patent App. No. 2008-261079, mailed Mar. 12, 2013.
International Search report for PCT/JP2010/064698 (English and Japanese) , mailed Nov. 2, 2010.
English language version of International Preliminary Report on Patentability for PCT/JP2010/064698, mailed Mar. 29, 2012.
Search Report issued with respect to patent family member European Patent Application No. 10783178.6, mailed Oct. 29, 2012.
English-language translation of International Preliminary Report on Patentability issued with respect to PCT/JP2009/055666, mailed Nov. 18, 2010.
English-language translation of International Preliminary Report on Patentability issued with respect to PCT/JP2009/055690, mailed Nov. 18, 2010.
Office Action issued with respect to Japanese Patent Application No. 2008-006024, mailed Dec. 4, 2012.
Japanese Office Action issued with respect to Japanese Patent Application No. 2009-135366, mailed Dec. 3, 2013.
U.S. Appl. No. 13/392,189 to Akio Mutou et al., filed Feb. 24, 2012.
Office Action issued with respect to U.S. Appl. No. 12/812,524, mailed Jan. 22, 2013.
Notification of Information Provision issued with respect to corresponding Japanese Patent Application No. 2009-135369, mailed May 29, 2012.
Notification of Information Provision issued with respect to Japanese Patent Application No. 2009-135444, mailed Jun. 19, 2012.
Notice of Information Provision of EP Application No. 10842116.5, mailed May 28, 2014.
Search Report of European Patent Application No. 10842116.5, mailed Feb. 12, 2014.
Japan Office Action of JP Patent Application No. 2010-002270, mailed Oct. 22, 2013.
International Search Report of PCT/JP2010/0066708, mailed Dec. 28, 2010.
English-language translation of International Preliminary Report on Patentability issue with respect to PCT/JP2010/0066708, mailed Aug. 23, 2012.
Notification of Information Provision issue with respect to Japanese Patent Application No. 2010-002270, mailed Jun. 12, 2012.
Japan Office Action of JP Patent Application No. 2013-192122, mailed Jul. 8, 2014.
U.S. Appl. No. 13/322,975, filed Nov. 29, 2011.
Search Report of PCT/JP2010/057957, mailed Aug. 17, 2010.
International Search Report for PCT/JP2010/059196, mailed Aug. 31, 2010.
International Preliminary Report on Patentability for PCT/JP2010/059196, mailed Jan. 26, 2012.
Extended European Search Report for EP 10783345.1, which was mailed on Feb. 12, 2014.
Notice of Information Provision for JP 2009-135377, which was mailed on Nov. 26, 2013.
Japanese Office Action for JP 2009-135369, which is dated Jul. 16, 2013.
Japanese Office Action for JP 2008-261070, which is dated Jul. 2, 2013.
Japanese Office Action for JP 2008-261079, which is dated May 21, 2013.
Notice of Information Provision for JP 2008-006024, which is dated May 14, 2013.
Chinese Office Action for CN 200980110123.8, which is dated Apr. 1, 2013.
International Search Report for PCT/JP2010/057957, which was mailed on Aug. 17, 2010.
International Search Report for PCT/JP2010/059196, which is dated Aug. 31, 2010.
International Preliminary Report on Patentability for PCT/JP2010/059196, which is dated Jan. 26, 2012.
Office Action for U.S. Appl. No. 12/812,524, which is dated Aug. 28, 2012.
Notice of Information Provision for JP Patent Application No. P2009-135377, which was mailed on Jun. 3, 2014.
Tsuyoshi, Yuki, "Technologies for Inproving Lubricating Performances in Viscosity Index Improver for Low Viscosity Lubricants," Tribologists, vol. 53, No. 7, 2008, p. 449-455; along with a partial English translation.
Hideo, Tanaka, "Viscosity Index Improver," Tribologists, vol. 52, No. 11, 2007, p. 789-792; along with a partial English translation.
U.S. Appl. No. 13/520,679, filed Jul. 5, 2012.
Notice of Allowance for Counterpart Japanese Patent Application No. JP 2013-192122 mailed Oct. 28, 2014.

* cited by examiner

LUBRICANT OIL COMPOSITION AND METHOD FOR MAKING THE SAME

TECHNICAL FIELD

The present invention relates to a lubricating oil composition and to a method for producing the same.

BACKGROUND ART

Lubricating oils have been used in the past in internal combustion engines, gearboxes and other mechanical devices to produce smoother functioning.

Internal combustion engine lubricating oils (engine oils), in particular, must exhibit a high level of performance under the high-performance, high-output and harsh operating conditions of internal combustion engines. Various additives such as anti-wear agents, metallic detergents, ash-free dispersants and antioxidants are therefore added to conventional engine oils to meet such performance demands (see Patent documents 1-3). The fuel efficiency performance required of lubricating oils has continued to increase in recent years, and this has led to application of various high-viscosity-index base oils or friction modifiers (see Patent document 4, for example).

Also, in the field of lubricating oils, additives such as viscosity index improvers and pour point depressants have conventionally been added to lubricating base oils, including highly refined mineral oils, to improve the viscosity-temperature characteristics or low-temperature viscosity characteristics of the lubricating oils (see Patent documents 5-7, for example). Known methods for producing high-viscosity-index base oils include methods in which stock oils containing natural or synthetic normal paraffins are subjected to lubricating base oil refining by hydrocracking/hydroisomerization (see Patent documents 8-10, for example). The properties evaluated for the low-temperature viscosity characteristics of lubricating base oils and lubricating oils are generally the pour point, clouding point and freezing point. Methods are also known for evaluating the low-temperature viscosity characteristics for lubricating base oils according to their normal paraffin or isoparaffin contents.

CITATION LIST

Patent Literature

[Patent document 1] Japanese Unexamined Patent Application Publication No. 2001-279287

[Patent document 2] Japanese Unexamined Patent Application Publication No. 2002-129182

[Patent document 3] Japanese Unexamined Patent Application Publication HEI No. 08-302378

[Patent document 4] Japanese Unexamined Patent Application Publication HEI No. 06-306384

[Patent document 5] Japanese Unexamined Patent Application Publication HEI No. 4-36391

[Patent document 6] Japanese Unexamined Patent Application Publication HEI No. 4-68082

[Patent document 7] Japanese Unexamined Patent Application Publication HEI No. 4-120193

[Patent document 8] Japanese Unexamined Patent Application Publication No. 2005-154760

[Patent document 9] Japanese Patent Public Inspection No. 2006-502298

[Patent document 10] Japanese Patent Public Inspection No. 2002-503754

SUMMARY OF INVENTION

Technical Problem

Conventional lubricating oils, however, cannot necessarily be considered adequate in terms of fuel efficiency.

For example, one common method for achieving fuel efficiency involves reducing the kinematic viscosity of the lubricating oil and increasing the viscosity index (multigrading by a combination of a low-viscosity base oil and a viscosity index improver). With such a method, however, the reduction in viscosity of the lubricating oil or the base oil composing it can reduce the lubricating performance under severe lubrication conditions (high-temperature, high-shear conditions), resulting in wear and seizing, as well as leading to problems such as fatigue fracture. In other words, with conventional lubricating oils it is difficult to impart sufficient fuel efficiency while maintaining practical performance in other ways such as durability.

Furthermore, while it is effective to raise the HTHS viscosity at 150° C. (the "HTHS viscosity" is also known as "high-temperature high-shear viscosity") and lower the kinematic viscosity at 40° C., the kinematic viscosity at 100° C. and the HTHS viscosity at 100° C., in order to prevent the aforementioned inconveniences and impart fuel efficiency while maintaining durability, it has been extremely difficult to satisfy all of these conditions with conventional lubricating oils.

The present invention has been accomplished in light of these circumstances, and its object is to provide a lubricating oil composition having a sufficiently high HTHS viscosity at 150° C., and a sufficiently low kinematic viscosity at 40° C., kinematic viscosity at 100° C. and HTHS viscosity at 100° C.

Solution to Problem

In order to solve the problems described above, the invention provides a lubricating oil composition comprising a lubricating base oil with a kinematic viscosity at 100° C. of 1-20 $mm^2/s$, and a viscosity index improver having a ratio M1/M2 of 0.20 or greater, between the total area of the peaks between chemical shifts of 36-38 ppm M1 and the total area of the peaks between chemical shifts of 64-66 ppm M2, with respect to the total area of all of the peaks, in the spectrum obtained by $^{13}C$-NMR.

Preferably, the lubricating base oil comprises a first lubricating base oil component having a urea adduct value of no greater than 5% by mass, a kinematic viscosity at 40° C. of at least 14 $mm^2/s$ and no greater than 25 $mm^2/s$ and a viscosity index of 120 or greater, and a second lubricating base oil component having a kinematic viscosity at 40° C. of 5 $mm^2/s$ or greater and less than 14 $mm^2/s$, wherein the content of the first lubricating base oil component is 10-99% by mass and the content of the second lubricating base oil component is 1-50% by mass, based on the total weight of the lubricating base oil.

In recent years, with the ever increasing demand for fuel efficiency of lubricating oils, the conventional lubricating base oils and viscosity index improvers have not always been adequate in terms of the viscosity-temperature characteristic and low-temperature viscosity characteristic. Particularly with SAE10 class lubricating base oils, or conventional lubricating oil compositions comprising them as major components, it is difficult to achieve high levels of both fuel efficiency and low-temperature viscosity (CCS viscosity, MR viscosity, and the like) while maintaining high-temperature high-shear viscosity.

If only the low-temperature viscosity is to be improved, this is possible if combined with the use of lubricating base oils that exhibit excellent low-temperature viscosity, such as synthetic oils including poly-α-olefinic base oils or esteric base oils, or low-viscosity mineral base oils, but such synthetic oils are expensive, while low-viscosity mineral base oils generally have low viscosity indexes and high NOACK evaporation. Consequently, adding such lubricating base oils increases the production cost of lubricating oils, or makes it difficult to achieve a high viscosity index and low evaporation properties. Moreover, only limited improvement in fuel efficiency can be achieved even when using these conventional lubricating base oils.

The lubricating oil composition of the invention, in contrast, when using a lubricating base oil comprising the aforementioned first and second lubricating base oil components in the specified proportions, can effectively realize a high-viscosity-index lubricating oil composition that has excellent fuel efficiency and low-temperature viscosity characteristics, and can exhibit both fuel efficiency and low temperature viscosity at −35° C. and below while maintaining high-temperature high-shear viscosity, and in particular, that can reduce the HTHS viscosity at 100° C. of the lubricating oil while maintaining a constant HTHS viscosity at 150° C., and that can notably improve the CCS viscosity at −35° C. and below.

The "urea adduct value" according to the invention is the value measured by the following method. A 100 g weighed portion of sample oil (lubricating base oil) is placed in a round bottom flask, 200 g of urea, 360 ml of toluene and 40 ml of methanol are added and the mixture is stirred at room temperature for 6 hours. This produces white particulate crystals in the reaction mixture. The reaction mixture is filtered with a 1 micron filter to obtain the produced white particulate crystals, and the crystals are washed 6 times with 50 ml of toluene. The recovered white crystals are placed in a flask, 300 ml of purified water and 300 ml of toluene are added and the mixture is stirred at 80° C. for 1 hour. The aqueous phase is separated and removed with a separatory funnel, and the toluene phase is washed 3 times with 300 ml of purified water. After dewatering treatment of the toluene phase by addition of a desiccant (sodium sulfate), the toluene is distilled off. The proportion (weight percentage) of hydrocarbon component (urea adduct) obtained in this manner with respect to the sample oil is defined as the urea adduct value.

With measurement of the urea adduct value, it is possible to accomplish precise and reliable collection of the components in isoparaffins that can adversely affect the low-temperature viscosity characteristic or components that impair the thermal conductivity, as well as normal paraffins when normal paraffins are residually present in the lubricating base oil, as urea adduct, and it is therefore an excellent indicator for evaluation of the low-temperature viscosity characteristic and thermal conductivity of lubricating base oils. The present inventors have confirmed that when analysis is conducted using GC and NMR, the main urea adducts are urea adducts of normal paraffins and of C6 or greater isoparaffins from the main chain to the point of branching.

The lubricating base oil preferably has distillation properties such that the initial boiling point is no higher than 370° C., the 90% distillation temperature is 430° C. or higher, and the difference between the 90% distillation temperature and 10% distillation temperature is at least 50° C.

As used herein, the terms "initial boiling point" and "90% distillation temperature", and the 10% distillation temperature, 50% distillation temperature and final boiling point explained hereunder, are the initial boiling point (IBP), 90% distillation temperature (T90), 10% distillation temperature (T10), 50% distillation temperature (T50) and final boiling point (FBP) as measured according to ASTM D 2887-97. The difference between the 90% distillation temperature and 10% distillation temperature, for example, will hereunder be represented as "T90-T10".

In the lubricating oil composition of the invention, the viscosity index improver is preferably a poly(meth)acrylate-based viscosity index improver.

Also, the viscosity index improver preferably has a PSSI of no greater than 40 and a weight-average molecular weight/PSSI ratio of at least $1\times10^4$.

The abbreviation "PSSI" used for the invention stands for the "Permanent Shear Stability Index" of the polymer, which is calculated according to ASTM D 6022-01 (Standard Practice for Calculation of Permanent Shear Stability Index) based on data measured according to ASTM D 6278-02 (Test Method for Shear Stability of Polymer Containing Fluids Using a European Diesel Injector Apparatus).

The lubricating oil composition of the invention preferably also contains at least one friction modifier selected from among organic molybdenum compounds and ash-free friction modifiers.

Also, the ratio of the HTHS viscosity at 100° C. with respect to the HTHS viscosity at 150° C. in the lubricating oil composition of the invention preferably satisfies the condition represented by the following inequality (A).

$$\text{HTHS}(100^\circ\text{ C.})/\text{HTHS}(150^\circ\text{ C.})\leq 2.04 \quad \text{(A)}$$

wherein HTHS (100° C.) represents the HTHS viscosity at 100° C. and HTHS (150° C.) represents the HTHS viscosity at 150° C.

The invention further provides a method for producing a lubricating oil composition in which a first lubricating base oil component having a urea adduct value of no greater than 5% by mass, a kinematic viscosity at 40° C. of at least 14 $mm^2/s$ and no greater than 25 $mm^2/s$ and a viscosity index of 120 or greater, a second lubricating base oil component having a kinematic viscosity at 40° C. of 5 $mm^2/s$ or greater and less than 14 $mm^2/s$, and a viscosity index improver having a ratio M1/M2 of 0.20 or greater, between the total area of the peaks between chemical shifts of 36-38 ppm M1 and the total area of the peaks between chemical shifts of 64-66 ppm M2, with respect to the total area of all of the peaks in the spectrum obtained by $^{13}$C-NMR, are combined to obtain a lubricating oil composition having a first lubricating base oil component content of 10-99% by mass and a second lubricating base oil component content of 1-50% by mass, based on the total weight of the lubricating base oil, and a kinematic viscosity at 100° C. of 4-12 $mm^2/s$ and a viscosity index of 200-350.

Advantageous Effects of Invention

Thus, it is possible to according to the invention to provide a lubricating oil composition having a sufficiently high HTHS viscosity at 150° C., and a sufficiently low kinematic viscosity at 40° C., a sufficiently low kinematic viscosity at 100° C. and a sufficiently low HTHS viscosity at 100° C. For example, with a lubricating oil composition of the invention it is possible to exhibit adequate fuel efficiency while maintaining a desired value for the HTHS viscosity at 150° C., without using a synthetic oil such as a poly-α-olefin-based base oil or esteric base oil, or a low-viscosity mineral base oil.

The lubricating oil composition of the invention is also useful for gasoline engines, diesel engines and gas engines for two-wheel vehicles, four-wheel vehicles, electric power generation and cogeneration, and the like, while it can be suitably used not only for such engines that run on fuel with a sulfur content of no greater than 50 ppm by mass, but also for ship engines, outboard motor engines and the like. Because of its excellent viscosity-temperature characteristic, the lubricating oil composition of the invention is particularly effective for increasing fuel efficiency of engines having roller tappet-type valve gear systems.

When a lubricating base oil comprising the first and second lubricating base oil component in the proportions specified above is used in a lubricating oil composition of the invention, it is possible to effectively realize a lubricating oil composition having excellent fuel efficiency and low-temperature viscosity characteristics, as well as an excellent low evaporation property. It is therefore possible to achieve both fuel efficiency and low-temperature viscosity at below −35° C. while maintaining the HTHS viscosity at 150° C., even without using a synthetic oil such as a poly-α-olefinic base oil or esteric base oil, or a low-viscosity mineral base oil, while also reducing the NOACK evaporation. In particular, it is possible to lower the 40° C. and kinematic viscosity at 100° C. and the HTHS viscosity at 100° C. of the lubricating oil, and notably improve the −35° C. CCS viscosity (−40° C. MR viscosity).

According to the method for producing a lubricating oil composition according to the invention, it is possible to easily and reliably obtain a lubricating oil composition of the invention having the excellent properties described above.

DESCRIPTION OF EMBODIMENTS

Preferred embodiments of the invention will now be described in detail.

[First Embodiment]

The lubricating oil composition according to the first embodiment of the invention comprises a lubricating base oil with a kinematic viscosity at 100° C. of 1-20 $mm^2/s$, and a viscosity index improver having a ratio M1/M2 of 0.20 or greater, between the total area of the peaks between chemical shifts of 36-38 ppm M1 and the total area of the peaks between chemical shifts of 64-66 ppm M2, with respect to the total area of all of the peaks, in the spectrum obtained by $^{13}C$-NMR.

For the first embodiment there was used a lubricating base oil having a kinematic viscosity at 100° C. of 1-20 $mm^2/s$ (hereunder referred to as "lubricating base oil of the first embodiment").

The lubricating base oil of the first embodiment is not particularly restricted so long as the kinematic viscosity at 100° C. satisfies this condition. Specifically, there may be mentioned purified paraffinic mineral oils produced by subjecting a lube-oil distillate obtained by atmospheric distillation and/or vacuum distillation of crude oil to a single treatment or two or more treatments, selected from among refining treatments such as solvent deasphalting, solvent extraction, hydrocracking, solvent dewaxing, catalytic dewaxing, hydrorefining, sulfuric acid cleaning and white clay treatment, or normal-paraffinic base oils, isoparaffinic base oils and the like, whose kinematic viscosity at 100° C., % $C_p$ and % $C_A$ satisfy the aforementioned conditions.

As a preferred example for the lubricating base oil of the first embodiment, there may be mentioned a base oil obtained by using one of the base oils (1)-(8) mentioned below as the raw material and purifying this stock oil and/or the lube-oil distillate recovered from the stock oil by a prescribed refining process, and recovering the lube-oil distillate.

(1) Distilled oil from atmospheric distillation of a paraffin-based crude oil and/or mixed-base crude oil.
(2) Distilled oil from vacuum distillation of atmospheric distillation residue oil from paraffin-based crude oil and/or mixed-base crude oil (WVGO).
(3) Wax obtained by a lubricating oil dewaxing step (slack wax or the like) and/or synthetic wax obtained by a gas-to-liquid (GTL) process (Fischer-Tropsch wax, GTL wax or the like).
(4) Blended oil comprising one or more oils selected from among base oils (1)-(3) and/or mild-hydrocracked oil obtained from the blended oil.
(5) Blended oil comprising two or more selected from among base oils (1)-(4).
(6) Deasphalted oil (DAO) from base oil (1), (2), (3), (4) or (5).
(7) Mild-hydrocracked oil (MHC) obtained from base oil (6).
(8) Blended oil comprising two or more selected from among base oils (1)-(7).

The prescribed refining process described above is preferably hydrorefining such as hydrocracking or hydrofinishing; solvent refining such as furfural solvent extraction; dewaxing such as solvent dewaxing or catalytic dewaxing; white clay refining with acidic white clay or active white clay, or chemical (acid or alkali) washing such as sulfuric acid treatment or caustic soda washing. For the first embodiment, any one of these refining processes may be used alone, or a combination of two or more thereof may be used in combination. When a combination of two or more refining processes is used, their order is not particularly restricted and may be selected as appropriate.

The lubricating base oil of the first embodiment is most preferably one of the following base oils (9) or (10) obtained by prescribed treatment of a base oil selected from among base oils (1)-(8) above or a lube-oil distillate recovered from the base oil.

(9) Hydrocracked mineral oil obtained by hydrocracking of a base oil selected from among base oils (1)-(8) above or a lube-oil distillate recovered from the base oil, dewaxing treatment such as solvent dewaxing or catalytic dewaxing of the product or a lube-oil distillate recovered from distillation of the product, or further distillation after the dewaxing treatment.
(10) Hydroisomerized mineral oil obtained by hydroisomerization of a base oil selected from among base oils (1)-(8) above or a lube-oil distillate recovered from the base oil, and dewaxing treatment such as solvent dewaxing or catalytic dewaxing of the product or a lube-oil distillate recovered from distillation of the product, or further distillation after the dewaxing treatment.

For obtaining the lubricating base oil of (9) or (10) above, a solvent refining treatment and/or hydrofinishing treatment step may also be carried out by convenient steps if necessary.

There are no particular restrictions on the catalyst used for the hydrocracking and hydroisomerization, but there are preferably used hydrocracking catalysts comprising a hydrogenating metal (for example, one or more metals of Group VIa or metals of Group VIII of the Periodic Table) supported on a carrier which is a complex oxide with decomposing activity (for example, silica-alumina, alumina-boria, silica-zirconia or the like) or a combination of two or more of such complex oxides bound with a binder, or hydroisomerization catalysts obtained by supporting one or more metals of Group VIII having hydrogenating activity on a carrier comprising zeolite (for example, ZSM-5, zeolite beta, SAPO-11 or the like). The hydrocracking catalyst or hydroisomerization catalyst may be used as a combination of layers or a mixture.

The reaction conditions for hydrocracking and hydroisomerization are not particularly restricted, but preferably the hydrogen partial pressure is 0.1-20 MPa, the mean reaction temperature is 150-450° C., the LHSV is 0.1-3.0 $hr^{-1}$ and the hydrogen/oil ratio is 50-20,000 scf/b.

The kinematic viscosity at 100° C. of the lubricating base oil of the first embodiment is no greater than 20 $mm^2/s$, preferably no greater than 10 $mm^2/s$, more preferably no greater than 7 $mm^2/s$, even more preferably no greater than 5.0 $mm^2/s$, especially preferably no greater than 4.5 $mm^2/s$ and most preferably no greater than 4.0 $mm^2/s$. Also, the kinematic viscosity at 100° C. is also preferably 1 $mm^2/s$ or greater, more preferably 1.5 $mm^2/s$ or greater, even more preferably 2 $mm^2/s$ or greater, yet more preferably 2.5 $mm^2/s$ or greater and most preferably 3 $mm^2/s$ or greater. The kinematic viscosity at 100° C. according to the invention is the kinematic viscosity at 100° C. measured according to ASTM D-445. If the kinematic viscosity at 100° C. of the lubricating base oil component exceeds 10 $mm^2/s$, the low-temperature viscosity characteristic may be impaired and sufficient fuel efficiency may not be obtained, while if it is 1 $mm^2/s$ or lower, oil film formation at the lubricated sections will be inadequate, resulting in inferior lubricity and potentially large evaporation loss of the lubricating oil composition.

According to the first embodiment, a lubricating base oil having a kinematic viscosity at 100° C. in one of the following ranges is preferably used after fractionation by distillation or the like.

(I) A lubricating base oil with a kinematic viscosity at 100° C. of at least 1.5 $mm^2/s$ and less than 3.5 $mm^2/s$, and more preferably 2.0-3.0 $mm^2/s$.

(II) A lubricating base oil with a kinematic viscosity at 100° C. of at least 3.5 $mm^2/s$ and less than 4.5 $mm^2/s$, and more preferably 3.5-4.1 $mm^2/s$.

(III) A lubricating base oil with a kinematic viscosity at 100° C. of 4.5-10 $mm^2/s$, more preferably 4.8-9 $mm^2/s$ and most preferably 5.5-8.0 $mm^2/s$.

The kinematic viscosity at 40° C. of the lubricating base oil of the invention is preferably no greater than 80 $mm^2/s$, more preferably no greater than 50 $mm^2/s$, even more preferably no greater than 20 $mm^2/s$, yet more preferably no greater than 18 $mm^2/s$ and most preferably no greater than 16 $mm^2/s$. Also, the kinematic viscosity at 40° C. is preferably 6.0 $mm^2/s$ or greater, more preferably 8.0 $mm^2/s$ or greater, even more preferably 12 $mm^2/s$ or greater, yet more preferably 14 $mm^2/s$ or greater and most preferably 15 $mm^2/s$ or greater. If the kinematic viscosity at 40° C. of the lubricating base oil component exceeds 80 $mm^2/s$, the low-temperature viscosity characteristic may be impaired and sufficient fuel efficiency may not be obtained, while if it is 6.0 $mm^2/s$ or lower, oil film formation at the lubricated sections will be inadequate, resulting in inferior lubricity and potentially large evaporation loss of the lubricating oil composition. Also according to the first embodiment, a lube-oil distillate having a kinematic viscosity at 40° C. in one of the following ranges is preferably used after fractionation by distillation or the like.

(IV) A lubricating base oil with a kinematic viscosity at 40° C. of at least 6.0 $mm^2/s$ and less than 12 $mm^2/s$, and more preferably 8.0-12 $mm^2/s$.

(V) A lubricating base oil with a kinematic viscosity at 40° C. of at least 12 $mm^2/s$ and less than 28 $mm^2/s$, and more preferably 13-19 $mm^2/s$.

(VI) A lubricating base oil with a kinematic viscosity at 40° C. of 28-50 $mm^2/s$, more preferably 29-45 $mm^2/s$ and most preferably 30-40 $mm^2/s$.

The viscosity index of the lubricating base oil of the first embodiment is preferably 120 or greater. Also, the viscosity index for the lubricating base oils (I) and (IV) is preferably 120-135 and more preferably 120-130. The viscosity index for the lubricating base oils (II) and (V) is preferably 120-160, more preferably 125-150 and even more preferably 135-145. Also, the viscosity index for the lubricating base oils (III) and (VI) is preferably 120-180 and more preferably 125-160. A viscosity index below these lower limits will not only impair the viscosity-temperature characteristic, heat and oxidation stability and resistance to volatilization, but will also tend to increase the frictional coefficient and potentially lower the anti-wear property. If the viscosity index exceeds the aforementioned upper limit, the low-temperature viscosity characteristic will tend to be reduced.

The viscosity index for the purpose of the invention is the viscosity index measured according to JIS K 2283-1993.

The 15° C. density ($\rho_{15}$) of the lubricating base oil of the first embodiment will also depend on the viscosity grade of the lubricating base oil component, but it is preferably no greater than the value of $\rho$ represented by the following formula (B), i.e., $\rho_{15} \leq \rho$.

$$\rho = 0.0025 \times kv100 + 0.816 \quad \text{(B)}$$

wherein kv100 represents the kinematic viscosity at 100° C. ($mm^2/s$) of the lubricating base oil component.

If $\rho_{15} > \rho$, the viscosity-temperature characteristic and heat and oxidation stability, as well as the resistance to volatilization and low-temperature viscosity characteristic, will tend to be lowered, thus potentially impairing the fuel efficiency. In addition, the efficacy of additives included in the lubricating base oil component may be reduced.

Specifically, the 15° C. density ($\rho_{15}$) of the lubricating base oil of the invention is preferably no greater than 0.860, more preferably no greater than 0.850, even more preferably no greater than 0.840 and most preferably no greater than 0.822.

The 15° C. density for the purpose of the invention is the density measured at 15° C. according to JIS K 2249-1995.

The pour point of the lubricating base oil of the first embodiment will depend on the viscosity grade of the lubricating base oil, and for example, the pour point for the lubricating base oils (I) and (IV) is preferably no higher than −10° C., more preferably no higher than −12.5° C. and even more preferably no higher than −15° C. Also, the pour point for the lubricating base oils (II) and (V) is preferably no higher than −10° C., more preferably no higher than −15° C. and even more preferably no higher than −17.5° C. The pour point for the lubricating base oils (III) and (VI) is preferably no higher than −10° C., more preferably no higher than −12.5° C. and even more preferably no higher than −15° C. If the pour point exceeds the upper limit specified above, the low-temperature flow properties of lubricating oils employing the lubricating base oils will tend to be reduced. The pour point for the purpose of the invention is the pour point measured according to JIS K 2269-1987.

The aniline point (AP (° C.)) of the lubricating base oil of the first embodiment will also depend on the viscosity grade of the lubricating base oil, but it is preferably greater than or equal to the value of A as represented by the following formula (B), i.e., $AP \geq A$.

$$A = 4.3 \times kv100 + 100 \quad \text{(B)}$$

wherein kv100 represents the kinematic viscosity at 100° C. ($mm^2/s$) of the lubricating base oil.

If $AP < A$, the viscosity-temperature characteristic, heat and oxidation stability, resistance to volatilization and low-temperature viscosity characteristic of the lubricating base oil will tend to be reduced, while the efficacy of additives when added to the lubricating base oil will also tend to be reduced.

The AP for the lubricating base oils (I) and (IV) is preferably 108° C. or higher and more preferably 110° C. or higher. The AP for the lubricating base oils (II) and (V) is preferably 113° C. or higher and more preferably 119° C. or higher. Also, the AP for the lubricating base oils (III) and (VI) is preferably 125° C. or higher and more preferably 128° C. or higher. The aniline point for the purpose of the invention is the aniline point measured according to HS K 2256-1985.

The iodine value of the lubricating base oil of the first embodiment is preferably no greater than 3, more preferably no greater than 2, even more preferably no greater than 1, yet more preferably no greater than 0.9 and most preferably no greater than 0.8. Although the value may be less than 0.01, in consideration of the fact that this does not produce any further significant effect and is uneconomical, the value is preferably 0.001 or greater, more preferably 0.01 or greater, even more preferably 0.03 or greater and most preferably 0.05 or greater. Limiting the iodine value of the lubricating base oil component to no greater than 3 can drastically improve the heat and oxidation stability. The "iodine value" for the purpose of the invention is the iodine value measured by the indicator titration method according to JIS K 0070, "Acid Values, Saponification Values, Iodine Values, Hydroxyl Values And Unsaponification Values Of Chemical Products".

The sulfur content in the lubricating base oil of the first embodiment will depend on the sulfur content of the starting material. For example, when using a substantially sulfur-free starting material as for synthetic wax components obtained by Fischer-Tropsch reaction, it is possible to obtain a substantially sulfur-free lubricating base oil. When using a sulfur-containing starting material, such as slack wax obtained by a lubricating base oil refining process or microwax obtained by a wax refining process, the sulfur content of the obtained lubricating base oil will normally be 100 ppm by mass or greater. From the viewpoint of further improving the heat and oxidation stability and reducing sulfur, the sulfur content in the lubricating base oil of the first embodiment is preferably no greater than 100 ppm by mass, more preferably no greater than 50 ppm by mass, even more preferably no greater than 10 ppm by mass and especially no greater than 5 ppm by mass.

The nitrogen content in the lubricating base oil of the first embodiment is not particularly restricted, but is preferably no greater than 7 ppm by mass, more preferably no greater than 5 ppm by mass and even more preferably no greater than 3 ppm by mass. If the nitrogen content exceeds 5 ppm by mass, the heat and oxidation stability will tend to be reduced. The nitrogen content for the purpose of the invention is the nitrogen content measured according to JIS K 2609-1990.

The % $C_p$ value of the lubricating base oil of the invention is preferably at least 70, and it is preferably 80-99, more preferably 85-95, even more preferably 87-94 and most preferably 90-94. If the % $C_p$ value of the lubricating base oil is less than the aforementioned lower limit, the viscosity-temperature characteristic, heat and oxidation stability and frictional properties will tend to be reduced, while the efficacy of additives when added to the lubricating base oil will also tend to be reduced. If the % $C_p$ value of the lubricating base oil is greater than the aforementioned upper limit, on the other hand, the additive solubility will tend to be lower.

The % $C_A$ of the lubricating base oil of the first embodiment is preferably no greater than 2, and it is more preferably no greater than 1, even more preferably no greater than 0.8 and most preferably no greater than 0.5. If the % $C_A$ value of the lubricating base oil exceeds the aforementioned upper limit, the viscosity-temperature characteristic, heat and oxidation stability and fuel efficiency will tend to be reduced.

The % $C_N$ value of the lubricating base oil of the first embodiment is preferably no greater than 30, more preferably 4-25, even more preferably 5-13 and most preferably 5-8. If the % $C_N$ value of the lubricating base oil exceeds the aforementioned upper limit, the viscosity-temperature characteristic, heat and oxidation stability and frictional properties will tend to be reduced. If the % $C_N$ is less than the aforementioned lower limit, the additive solubility will tend to be lower.

The % $C_P$, % $C_N$ and % $C_A$ values for the purpose of the invention are, respectively, the percentage of paraffinic carbons with respect to total carbon atoms, the percentage of naphthenic carbons with respect to total carbons and the percentage of aromatic carbons with respect to total carbons, as determined by the method of ASTM D 3238-85 (n-d-M ring analysis). That is, the preferred ranges for % $C_P$, % $C_N$ and % $C_A$ are based on values determined by these methods, and for example, % $C_N$ may be a value exceeding 0 according to these methods even if the lubricating base oil contains no naphthene portion.

The aromatic content in the lubricating base oil of the first embodiment is not particularly restricted so long as the kinematic viscosity at 100° C., % $C_p$ and % $C_A$ values satisfy the conditions specified above, but it is preferably 90% by mass or greater, more preferably 95% by mass or greater and even more preferably 99% by mass or greater based on the total weight of the lubricating base oil, while the proportion of cyclic saturated components of the saturated components is preferably no greater than 40% by mass, more preferably no greater than 35% by mass, even more preferably no greater than 30% by mass, yet more preferably no greater than 25% by mass and most preferably no greater than 21% by mass. The proportion of cyclic saturated components among the saturated components is preferably 5% by mass or greater and more preferably 10% by mass or greater. If the saturated component content and proportion of cyclic saturated components among the saturated components both satisfy these respective conditions, it will be possible to improve the viscosity-temperature characteristic and heat and oxidation stability, while additives added to the lubricating base oil will be kept in a sufficiently stable dissolved state in the lubricating base oil so that the functions of the additives can be exhibited at a higher level. Furthermore, according to the first embodiment, it is possible to improve the frictional properties of the lubricating base oil itself, and as a result increase the friction reducing effect and thereby increase energy efficiency.

The "saturated components" for the purpose of the invention are measured by the method of ASTM D 2007-93.

Other methods may be used for separation of the saturated components or for compositional analysis of the cyclic saturated components and acyclic saturated components, so long as they provide similar results. Examples of other methods include the method according to ASTM D 2425-93, the method according to ASTM D 2549-91, methods of high performance liquid chromatography (HPLC), and modified forms of these methods.

The aromatic content in the lubricating base oil of the first embodiment is not particularly restricted so long as the kinematic viscosity at 100° C., % $C_p$ and % $C_A$ values satisfy the conditions specified above, but it is preferably no greater than 5% by mass, more preferably no greater than 4% by mass, even more preferably no greater than 3% by mass and most preferably no greater than 2% by mass, and also preferably 0.1% by mass or greater, more preferably 0.5% by mass or greater, even more preferably 1% by mass or greater and most preferably 1.5% by mass or greater, based on the total weight of the lubricating base oil. If the aromatic content exceeds the aforementioned upper limit, the viscosity-temperature characteristic, heat and oxidation stability, frictional properties, resistance to volatilization and low-temperature viscosity characteristic will tend to be reduced, while the efficacy of additives when added to the lubricating base oil will also tend to be reduced. The lubricating base oil of the first embodiment may be free of aromatic components, but the solubility of additives can be further increased with an aromatic content above the aforementioned lower limit.

The aromatic content, according to the invention, is the value measured according to ASTM D 2007-93. The aromatic portion normally includes alkylbenzenes and alkylnaphthalenes, as well as anthracene, phenanthrene and their alkylated forms, compounds with four or more fused benzene rings, and heteroatom-containing aromatic compounds such as pyridines, quinolines, phenols, naphthols and the like.

The lubricating base oil of the first embodiment may be used alone as a lubricating oil composition according to the first embodiment, or the lubricating base oil of the first embodiment may be combined with one or more other base oils. When the lubricating base oil of the first embodiment is combined with another base oil, the proportion of the lubricating base oil of the first embodiment of the total mixed base oil is preferably at least 30% by mass, more preferably at least 50% by mass and even more preferably at least 70% by mass.

There are no particular restrictions on the other base oil used in combination with the lubricating base oil of the first embodiment, and as examples of mineral base oils there may be mentioned solvent refined mineral oils, hydrocracked mineral oil, hydrorefined mineral oils and solvent dewaxed base oils having 100° C. dynamic viscosities of 1-100 $mm^2/s$ and % $C_p$ and % $C_A$ values that do not satisfy the aforementioned conditions.

As synthetic base oils there may be mentioned poly-α-olefins and their hydrogenated forms, isobutene oligomers and their hydrogenated forms, isoparaffins, alkylbenzenes, alkylnaphthalenes, diesters (ditridecyl glutarate, di-2-ethylhexyl adipate, diisodecyl adipate, ditridecyl adipate, di-2-ethylhexyl sebacate and the like), polyol esters (trimethylolpropane caprylate, trimethylolpropane pelargonate, pentaerythritol 2-ethylhexanoate, pentaerythritol pelargonate and the like), polyoxyalkylene glycols, dialkyldiphenyl ethers and polyphenyl ethers, which have 100° C. dynamic viscosities that do not satisfy the conditions specified above, and poly-α-olefins are preferred among these. As typical poly-α-olefins there may be mentioned C2-32 and preferably C6-16 α-olefin oligomers or co-oligomers (1-octene oligomer, decene oligomer, ethylene-propylene co-oligomers and the like), and their hydrides.

There are no particular restrictions on the process for producing poly-α-olefins, and as an example there may be mentioned a process wherein an α-olefin is polymerized in the presence of a polymerization catalyst such as a Friedel-Crafts catalyst comprising a complex of aluminum trichloride or boron trifluoride with water, an alcohol (ethanol, propanol, butanol or the like) and a carboxylic acid or ester.

The viscosity index improver used for the first embodiment preferably has a ratio of at least 0.20 for M1/M2, as the ratio between the total area of the peaks between chemical shifts of 36-38 ppm M1 and the total area of the peaks between chemical shifts of 64-66 ppm M2, with respect to the total area of all of the peaks, in the spectrum obtained by nuclear magnetic resonance analysis ($^{13}$C-NMR).

M1/M2 is preferably 0.3 or greater, even more preferably 0.4 or greater, yet more preferably 0.5 or greater and most preferably 0.6 or greater. Also, M1/M2 is preferably no greater than 3.0, even more preferably no greater than 2.0, yet more preferably no greater than 1.0 and most preferably no greater than 0.8. If M1/M2 is less than 0.20, it may not be possible to obtain the necessary fuel efficiency, and the low-temperature viscosity characteristic may also be impaired. If M1/M2 exceeds 3.0, it may not be possible to obtain the necessary fuel efficiency, and the solubility and storage stability may also be impaired.

When the viscosity index improver contains a diluting oil, the nuclear magnetic resonance analysis ($^{13}$C-NMR) spectrum is for the polymer after separating the diluting oil by rubber film dialysis or the like.

The total area of the peaks between chemical shifts of 36-38 ppm (M1) with respect to the total area of all of the peaks is the ratio of the integrated intensity due to specific β-branched structures in the polymethacrylate side chains with respect to the integrated intensity for all carbons, as measured by $^{13}$C-NMR, while the total area of the peaks between chemical shifts of 64-66 ppm (M2) with respect to the total area of all of the peaks is the ratio of the integrated intensity due to specific straight-chain structures in the polymethacrylate side chains with respect to the integrated intensity for all carbons, as measured by $^{13}$C-NMR.

M1/M2 is the ratio between specific β-branched structures and specific straight-chain structures in the polymethacrylate side chains, but another method may be used so long as an equivalent effect is obtained. For $^{13}$C-NMR measurement, a dilution was used as the sample, obtained by adding 3 g of heavy chloroform to 0.5 g of test sample, and the measuring method was the gated decoupling method with a measuring temperature of room temperature and a resonance frequency of 125 MHz.

The following were measured based on these results:

(a) the total integrated intensity between chemical shifts of about 10-70 ppm (the total integrated intensity attributable to all carbons in the hydrocarbon), and (b) the total integrated intensity between chemical shifts of 36-38 ppm (the total integrated intensity attributable to specific β-branched structures), and (c) the total integrated intensity between chemical shifts of 64-66 ppm (the total integrated intensity attributable to specific straight-chain structures), and the percentage (%) of (b) was calculated against 100% for (a), as M1. Also, the percentage of (c) (%) with (a) as 100% was calculated as M2.

The viscosity index improver used for the first embodiment is preferably a poly(meth)acrylate, and the polymer preferably has a proportion of structural units represented by the following formula (1) of 0.5-70 mol %. The viscosity index improver may be non-dispersant or dispersant.

[Chemical Formula 1]

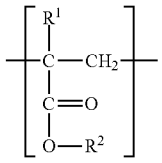

(1)

wherein $R^1$ represents hydrogen or a methyl group and $R^2$ represents a C16 or greater straight-chain or branched hydrocarbon, or an oxygen- and/or nitrogen-containing C16 or greater straight-chain or branched organic group.

$R^2$ in formula (1) is a C16 or greater straight-chain or branched hydrocarbon group, more preferably a C18 or greater straight-chain or branched hydrocarbon, even more preferably a C20 or greater straight-chain or branched hydrocarbon and most preferably a C20 or greater branched hydrocarbon group. There is no particular upper limit on the number of carbon atoms of the hydrocarbon group represented by $R^2$, but it is preferably no greater than a C100 straight-chain or branched hydrocarbon group. It is more preferably a C50 or lower straight-chain or branched hydrocarbon, even more preferably a C30 or lower straight-chain or branched hydrocarbon, yet more preferably a C30 or lower branched hydrocarbon and most preferably a C25 or lower branched hydrocarbon.

The proportion of (meth)acrylate structural units represented by formula (1) in the polymer for the viscosity index improver is 0.5-70 mol % as mentioned above, but it is preferably no greater than 60 mol %, more preferably no greater than 50 mol %, even more preferably no greater than 40 mol % and most preferably no greater than 30 mol %. It is also preferably 1 mol % or greater, more preferably 3 mol % or greater, even more preferably 5 mol % or greater and most preferably 10 mol % or greater. At greater than 70 mol % the viscosity-temperature characteristic-improving effect and the low-temperature viscosity characteristic may be impaired, and at below 0.5 mol % the viscosity-temperature characteristic-improving effect may be impaired.

The viscosity index improver may comprise any (meth) acrylate structural unit other than a (meth)acrylate structural unit represented by formula (1), or any olefin-derived structural unit.

Any production process may be employed for the viscosity index improver, and for example, it can be easily obtained by radical solution polymerization of a monomer mixture in the presence of a polymerization initiator such as benzoyl peroxide.

The PSSI (Permanent Shear Stability Index) of the viscosity index improver is preferably no greater than 50, more preferably no greater than 40, even more preferably no greater than 35 and most preferably no greater than 30. It is also preferably 5 or greater, more preferably 10 or greater, even more preferably 15 or greater and most preferably 20 or greater. If the PSSI is less than 5 the viscosity index improving effect may be reduced and cost increased, while if the PSSI is greater than 50 the shear stability or storage stability may be impaired.

The weight-average molecular weight ($M_W$) of the viscosity index improver is preferably 100,000 or greater, more preferably 200,000 or greater, even more preferably 250,000 or greater and most preferably 300,000 or greater. It is also preferably no greater than 1,000,000, more preferably no greater than 700,000, even more preferably no greater than 600,000 and most preferably no greater than 500,000. If the weight-average molecular weight is less than 100,000, the effect of improving the viscosity-temperature characteristic and viscosity index will be minimal, potentially increasing cost, while if the weight-average molecular weight is greater than 1,000,000 the shear stability, solubility in the base oil and storage stability may be impaired.

The number-average molecular weight ($M_N$) of the viscosity index improver is preferably 50,000 or greater, more preferably 800,000 or greater, even more preferably 100,000 or greater and most preferably 120,000 or greater. It is also preferably no greater than 500,000, more preferably no greater than 300,000, even more preferably no greater than 250,000 and most preferably no greater than 200,000. If the number-average molecular weight is less than 50,000, the effect of improving the viscosity-temperature characteristic and viscosity index will be minimal, potentially increasing cost, while if the weight-average molecular weight is greater than 500,000 the shear stability, solubility in the base oil and storage stability may be impaired.

The ratio of the weight-average molecular weight and PSSI of the viscosity index improver ($M_W$/PSSI) is preferably $0.8\times10^4$ or greater, more preferably $1.0\times10^4$ or greater, even more preferably $1.5\times10^4$ or greater, yet more preferably $1.8\times10^4$ and most preferably $2.0\times10^4$ or greater. If the $M_W$/PSSI ratio is less than $0.8\times10^4$, the viscosity-temperature characteristic, i.e. the fuel efficiency, may be impaired.

The ratio between the weight-average molecular weight and number-average molecular weight of the viscosity index improver ($M_W/M_N$) is preferably 0.5 or greater, more preferably 1.0 or greater, even more preferably 1.5 or greater, yet more preferably 2.0 or greater and most preferably 2.1 or greater. Also, $M_W/M_N$ is preferably no greater than 6.0, more preferably no greater than 4.0, even more preferably no greater than 3.5 and most preferably no greater than 3.0. If $M_W/M_N$ is less than 0.5 or greater than 6.0, the viscosity-temperature characteristic may be impaired, or in other words the fuel efficiency may be reduced.

The ratio of the increase in the kinematic viscosity at 40° C. by the viscosity index improver to the increase in the kinematic viscosity at 100° C. by the viscosity index improver, ΔKV40/ΔKV100, is preferably no greater than 4.0, more preferably no greater than 3.5, even more preferably no greater than 3.0, yet more preferably no greater than 2.5, and most preferably no greater than 2.3. The increase in the viscosity at 40° C. and 100° C. of. Also, ΔKV40/ΔKV100 is preferably 0.5 or greater, more preferably 1.0 or greater, even more preferably 1.5 or greater and most preferably 2.0 or greater. If ΔKV40/ΔKV100 is less than 0.5 the viscosity-increasing effect or solubility may be reduced and cost may be increased, while if it exceeds 4.0 the viscosity-temperature characteristic-improving effect or low-temperature viscosity characteristic may be inferior. ΔKV40 is the amount of increase in the kinematic viscosity at 40° C. when the viscosity index improver is added at 3.0% to YUBASE4 by SK Corp., and ΔKV100 is the amount of increase in the kinematic viscosity at 100° C. when the viscosity index improver is added at 3.0% to YUBASE4 by SK Corp.

The ratio of the increase in the HTHS viscosity at 100° C. by the viscosity index improver to the increase in the HTHS viscosity at 150° C. by the viscosity index improver, ΔHTHS100/ΔHTHS150, is preferably no greater than 2.0, more preferably no greater than 1.7, even more preferably no greater than 1.6 and most preferably no greater than 1.55. Also, ΔHTHS100/ΔHTHS150 is preferably 0.5 or greater, more preferably 1.0 or greater, even more preferably 1.2 or greater and most preferably 1.4 or greater. If it is less than 0.5 the viscosity-increasing effect or solubility may be reduced and cost may be increased, while if it exceeds 2.0 the viscosity-temperature characteristic-improving effect or low-temperature viscosity characteristic may be inferior. ΔHTHS100 is the amount of increase in the HTHS viscosity at 100° C. when the viscosity index improver is added at 3.0% to YUBASE4 by SK Corp., and ΔHTHS150 is the amount of increase in the HTHS viscosity at 150° C. when the viscosity index improver is added at 3.0% to YUBASE4 by SK Corp. Also, ΔHTHS100/ΔHTHS150 is the ratio between the increase in the HTHS viscosity at 100° C. and the increase in the HTHS viscosity at 150° C. The HTHS viscosity at 100° C., according to the invention, is the high-temperature high-shear viscosity at 100° C. according to ASTM D4683. The HTHS viscosity at 150° C. is the high-temperature high-shear viscosity at 150° C. according to ASTM D4683.

The viscosity index improver content of the lubricating oil composition of the first embodiment is preferably 0.01-50% by mass, more preferably 0.5-40% by mass, even more preferably 1-30% by mass and most preferably 5-20% by mass, based on the total weight of the composition. If the viscosity index improver content is less than 0.1% by mass, the viscosity index improving effect or product viscosity reducing effect will be minimal, potentially preventing improvement in fuel efficiency. A content of greater than 50% by mass will drastically increase production cost while requiring reduced base oil viscosity, and can thus risk lowering the lubricating performance under severe lubrication conditions (high-temperature, high-shear conditions), as well as causing problems such as wear, seizing and fatigue fracture.

The lubricating oil composition of the first embodiment preferably contains a poly(meth)acrylate with a weight-average molecular weight of no greater than 100,000, for performance improvement. The poly(meth)acrylate may be dispersant or non-dispersant, but it is preferably non-dispersant.

The poly(meth)acrylate is preferably a copolymer of one or more (meth)acrylate monomers comprising a C1-30 hydrocarbon group as a side chain group, more preferably a copolymer of one or more (meth)acrylate monomers comprising a C1-20 hydrocarbon group as a side chain group, even more preferably a copolymer of one or more (meth)acrylate monomers comprising a C1-18 hydrocarbon group as a side chain group, and most preferably a copolymer of one or more (meth)acrylate monomers comprising a C10-18 hydrocarbon group as a side chain group.

The PSSI (Permanent Shear Stability Index) of the poly (meth)acrylate is preferably no greater than 40, more preferably no greater than 30, even more preferably no greater than 20, yet more preferably no greater than 15 and most preferably no greater than 10. If the PSSI is greater than 40, the shear stability may be impaired and a poor low-temperature viscosity characteristic obtained.

The weight-average molecular weight ($M_W$) of the poly (meth)acrylate is preferably no greater than 100,000, and it is preferably no greater than 80,000, more preferably no greater than 60,000 and even more preferably no greater than 50,000. The weight-average molecular weight is preferably 1000 or greater, more preferably 5000 or greater, even more preferably 10,000 or greater and most preferably 30,000 or greater.] If the weight-average molecular weight is less than 1000, the effect of improved viscosity index and improved low-temperature viscosity characteristic will be minimal, potentially increasing cost, while if the weight-average molecular weight is greater than 100,000 the effects of improved shear stability and low-temperature viscosity characteristic may be impaired.

The ratio of the weight-average molecular weight and PSSI of the poly(meth)acrylate ($M_W$/PSSI) is preferably $1\times10^4$ or greater, more preferably $1.5\times10^4$ or greater, even more preferably $2\times10^4$ or greater and most preferably $2.5\times10^4$ or greater. If the $M_W$/PSSI ratio is less than $1\times10^4$, the viscosity-temperature characteristic and low-temperature viscosity characteristic may be impaired.

The poly(meth)acrylate content in the lubricating oil composition of the first embodiment is 0.01-10% by mass, preferably 0.02-8% by mass, more preferably 0.05-5% by mass and most preferably 0.1-3% by mass, based on the total weight of the lubricating oil composition. A first viscosity index improver content of less than 0.01% by mass may impair the viscosity-temperature characteristic or low-temperature viscosity characteristic. A content of greater than 10% by mass may impair the viscosity-temperature characteristic or low-temperature viscosity characteristic while also drastically increasing production cost and requiring reduced base oil viscosity, and can thus risk lowering the lubricating performance under severe lubrication conditions (high-temperature, high-shear conditions), as well as causing problems such as wear, seizing and fatigue fracture.

The lubricating oil composition of the first embodiment may further contain, as viscosity index improvers in addition to the aforementioned viscosity index improvers or poly (meth)acrylates, also common non-dispersant or dispersant poly(meth)acrylates, non-dispersant or dispersant ethylene-α-olefin copolymers or their hydrides, polyisobutylene or its hydride, styrene-diene hydrogenated copolymers, styrene-maleic anhydride ester copolymers and polyalkylstyrenes.

The lubricating oil composition of the first embodiment may also contain at least one compound selected from among organic molybdenum compounds and ash-free friction modifiers, in order to increase the fuel efficiency performance.

The organic molybdenum compound used in the first embodiment may be a sulfur-containing organic molybdenum compound such as molybdenum dithiophosphate or molybdenum dithiocarbamate.

Examples of preferred molybdenum dithiocarbamates include, specifically, molybdenum sulfide diethyl dithiocarbamate, molybdenum sulfide dipropyl dithiocarbamate, molybdenum sulfide dibutyl dithiocarbamate, molybdenum sulfide dipentyl dithiocarbamate, molybdenum sulfide dihexyl dithiocarbamate, molybdenum sulfide dioctyl dithiocarbamate, molybdenum sulfide didecyl dithiocarbamate, molybdenum sulfide didodecyl dithiocarbamate, molybdenum sulfide di(butylphenyl)dithiocarbamate, molybdenum sulfide di(nonylphenyl)dithiocarbamate, oxymolybdenum sulfide diethyl dithiocarbamate, oxymolybdenum sulfide dipropyl dithiocarbamate, oxymolybdenum sulfide dibutyl dithiocarbamate, oxymolybdenum sulfide dipentyl dithiocarbamate, oxymolybdenum sulfide dihexyl dithiocarbamate, oxymolybdenum sulfide dioctyl dithiocarbamate, oxymolybdenum sulfide didecyl dithiocarbamate, oxymolybdenum sulfide didodecyl dithiocarbamate, oxymolybdenum sulfide di(butylphenyl)dithiocarbamate and oxymolybdenum sulfide di(nonylphenyl)dithiocarbamate (where the alkyl groups may be linear or branched, and the alkyl groups may be bonded at any position of the alkylphenyl groups), as well as mixtures of the foregoing. Also preferred as molybdenum dithiocarbamates are compounds with different numbers of carbon atoms and/or structural hydrocarbon groups in the molecule.

Other sulfur-containing organic molybdenum compounds include complexes of molybdenum compounds (for example, molybdenum oxides such as molybdenum dioxide and molybdenum trioxide, molybdic acids such as orthomolybdic acid, paramolybdic acid and (poly)molybdic sulfide acid, molybdic acid salts such as metal salts or ammonium salts of these molybdic acids, molybdenum sulfides such as molybdenum disulfide, molybdenum trisulfide, molybdenum pentasulfide and polymolybdenum sulfide, molybdic sulfide, metal salts or amine salts of molybdic sulfide, halogenated molybdenums such as molybdenum chloride, and the like), with sulfur-containing organic compounds (for example, alkyl (thio)xanthates, thiadiazoles, mercaptothiadiazoles, thiocarbonates, tetrahydrocarbylthiuram disulfide, bis(di (thio)hydrocarbyldithio phosphonate)disulfide, organic (poly)sulfides, sulfurized esters and the like), or other organic compounds, or complexes of sulfur-containing molybdenum compounds such as molybdenum sulfide and molybdic sulfide with alkenylsuccinic acid imides.

The organic molybdenum compound used may be an organic molybdenum compound containing no sulfur as a constituent element.

As organic molybdenum compounds containing no sulfur as a constituent element there may be mentioned, specifically, molybdenum-amine complexes, molybdenum-succinic acid imide complexes, organic acid molybdenum salts, alcohol molybdenum salts and the like, among which molybdenum-amine complexes, organic acid molybdenum salts and alcohol molybdenum salts are preferred.

When an organic molybdenum compound is used in the lubricating oil composition of the first embodiment, there are no particular restrictions on the content, but it is preferably 0.001% by mass or greater, more preferably 0.005% by mass or greater, even more preferably 0.01% by mass or greater and most preferably 0.03% by mass or greater, and also preferably no greater than 0.2% by mass, more preferably no greater than 0.1% by mass, even more preferably no greater than 0.08% by mass and most preferably no greater than 0.06% by mass, in terms of molybdenum element based on the total weight of the composition. If the content is less than 0.001% by mass the heat and oxidation stability of the lubricating oil composition will be insufficient, and in particular it may not be possible to maintain superior cleanability for prolonged periods. On the other hand, if the content is greater than 0.2% by mass the effect will not be commensurate with the increased amount, and the storage stability of the lubricating oil composition will tend to be reduced.

As ash-free friction modifiers there may be used any compounds that are commonly used as friction modifiers for lubricating oils, examples of which include C6-50 compounds comprising in the molecule one or more hetero elements selected from among oxygen atoms, nitrogen atoms and sulfur atoms. More specifically, these include ash-free friction modifiers, including amine compounds, fatty acid esters, fatty acid amides, fatty acids, aliphatic alcohols, aliphatic ethers, urea-based compounds and hydrazide-based compounds, having in the molecule at least one C6-30 alkyl group or alkenyl group, and particularly at least one C6-30 straight-chain alkyl, straight-chain alkenyl, branched alkyl or branched alkenyl group.

The ash-free friction modifier content of the lubricating oil composition according to the first embodiment is preferably 0.01% by mass or greater, more preferably 0.1% by mass or greater and even more preferably 0.3% by mass or greater, and preferably no greater than 3% by mass, more preferably no greater than 2% by mass and even more preferably no greater than 1% by mass, based on the total weight of the composition. If the ash-free friction modifier content is less than 0.01% by mass the friction reducing effect by the addition will tend to be insufficient, while if it is greater than 3% by mass, the effects of the wear resistance additives may be inhibited, or the solubility of the additives may be reduced. An ash-free friction modifier is more preferably used as the friction modifier.

The lubricating oil composition of the first embodiment may further contain any additives commonly used in lubricating oils, for the purpose of enhancing performance. Examples of such additives include additives such as metallic detergents, ash-free dispersants, antioxidants, anti-wear agents (or extreme-pressure agents), corrosion inhibitors, anti-rust agents, demulsifiers, metal deactivators and anti-foaming agents.

As metallic detergents there may be mentioned normal salts, basic normal salts and overbased salts such as alkali metal sulfonates or alkaline earth metal sulfonates, alkali metal phenates or alkaline earth metal phenates, and alkali metal salicylates or alkaline earth metal salicylates. According to the first embodiment, it is preferred to use one or more alkali metal or alkaline earth metallic detergents selected from the group consisting of those mentioned above, and especially an alkaline earth metallic detergent. Preferred are magnesium salts and/or calcium salts, with calcium salts being particularly preferred.

As ash-free dispersants there may be used any ash-free dispersants used in lubricating oils, examples of which include mono- or bis-succinic acid imides with at least one C40-400 straight-chain or branched alkyl group or alkenyl group in the molecule, benzylamines with at least one C40-400 alkyl group or alkenyl group in the molecule, polyamines with at least one C40-400 alkyl group or alkenyl group in the molecule, and modified forms of the foregoing with boron compounds, carboxylic acids, phosphoric acids and the like. One or more selected from among any of the above may be added for use.

As antioxidants there may be mentioned phenol-based and amine-based ash-free antioxidants, and copper-based or molybdenum-based metal antioxidants. Specific examples include phenol-based ash-free antioxidants such as 4,4'-methylenebis(2,6-di-tert-butylphenol) and 4,4'-bis(2,6-di-tert-butylphenol), and amine-based ash-free antioxidants such as phenyl-α-naphthylamine, alkylphenyl-α-naphthylamine and dialkyldiphenylamine.

As anti-wear agents (or extreme-pressure agents) there may be used any anti-wear agents and extreme-pressure agents that are utilized in lubricating oils. For example, sulfur-based, phosphorus-based and sulfur/phosphorus-based extreme-pressure agents may be used, specific examples of which include phosphorous acid esters, thiophosphorous acid esters, dithiophosphorous acid esters, trithiophosphorous acid esters, phosphoric acid esters, thiophosphoric acid esters, dithiophosphoric acid esters and trithiophosphoric acid esters, as well as their amine salts, metal salts and their derivatives, dithiocarbamates, zinc dithiocarbamate, molybdenum dithiocarbamate, disulfides, polysulfides, olefin sulfides, sulfurized fats and oils, and the like. Sulfur-based extreme-pressure agents, and especially sulfurized fats and oils, are preferably added.

Examples of corrosion inhibitors include benzotriazole-based, tolyltriazole-based, thiadiazole-based and imidazole-based compounds.

Examples of anti-rust agents include petroleum sulfonates, alkylbenzene sulfonates, dinonylnaphthalene sulfonates, alkenylsuccinic acid esters and polyhydric alcohol esters.

As examples of demulsifiers there may be mentioned polyalkylene glycol-based nonionic surfactants such as polyoxyethylenealkyl ethers, polyoxyethylenealkylphenyl ethers and polyoxyethylenealkylnaphthyl ethers.

As examples of metal deactivator agents there may be mentioned imidazolines, pyrimidine derivatives, alkylthiadiazoles, mercaptobenzothiazoles, benzotriazole and its derivatives, 1,3,4-thiadiazolepolysulfide, 1,3,4-thiadiazolyl-2,5-bisdialkyl dithiocarbamate, 2-(alkyldithio)benzimidazole and β-(o-carboxybenzylthio)propionitrile.

Examples of antifoaming agents include silicone oils, alkenylsuccinic acid derivatives, polyhydroxyaliphatic alcohol and long-chain fatty acid esters, methyl salicylate and o-hydroxybenzyl alcohols, which have 25° C. dynamic viscosities of 1000-100,000 $mm^2/s$.

When such additives are added to the lubricating oil composition of the first embodiment, their contents are 0.01-10% by mass based on the total weight of the composition.

The kinematic viscosity at 100° C. of the lubricating oil composition of the first embodiment is preferably 4-12 $mm^2/s$, and it is preferably no greater than 9 $mm^2/s$, more preferably no greater than 8 $mm^2/s$, even more preferably no greater than 7.8 $mm^2/s$ and most preferably no greater than 7.6 $mm^2/s$. The kinematic viscosity at 100° C. of the lubricating oil composition of the first embodiment is preferably 5 $mm^2/s$ or greater, more preferably 6 $mm^2/s$ or greater, even more preferably 6.5 $mm^2/s$ or greater and most preferably 7 $mm^2/s$ or greater. The kinematic viscosity at 100° C. according to the invention is the kinematic viscosity at 100° C. measured according to ASTM D-445. If the kinematic viscosity at 100° C. is less than 4 $mm^2/s$, insufficient lubricity may result, and if it is greater than 12 $mm^2/s$ it may not be possible to obtain the necessary low-temperature viscosity and sufficient fuel efficiency performance.

The kinematic viscosity at 40° C. of the lubricating oil composition of the first embodiment is preferably 4-50 $mm^2/s$, more preferably no greater than 40 $mm^2/s$, even more preferably no greater than 35 $mm^2/s$, yet more preferably no greater than 32 $mm^2/s$ and most preferably no greater than 30 $mm^2/s$. The kinematic viscosity at 40° C. of the lubricating oil composition of the first embodiment is preferably 10 $mm^2/s$ or greater, more preferably 20 $mm^2/s$ or greater, even more preferably 25 $mm^2/s$ or greater and most preferably 27 $mm^2/s$ or greater. The kinematic viscosity at 40° C. according to the invention is the kinematic viscosity at 40° C. measured according to ASTM D-445. If the kinematic viscosity at 40° C. is less than 4 $mm^2/s$, insufficient lubricity may result, and if it is greater than 50 $mm^2/s$ it may not be possible to obtain the necessary low-temperature viscosity and sufficient fuel efficiency performance.

The viscosity index of the lubricating oil composition of the first embodiment is preferably in the range of 140-400, and it is preferably 190 or greater, more preferably 200 or greater, even more preferably 210 or greater and most preferably 220 or greater. If the viscosity index of the lubricating oil composition of the first embodiment is less than 140 it may be difficult to maintain the HTHS viscosity at 150° C. while improving fuel efficiency, and it may also be difficult to lower the −35° C. low-temperature viscosity. If the viscosity index of the lubricating oil composition of the first embodiment is greater than 400 the evaporation property may be poor, and problems may occur due to solubility of the additives or lack of compatibility with the sealant material.

The HTHS viscosity at 100° C. of the lubricating oil composition of the first embodiment is preferably no greater than 5.5 mPa·s, more preferably no greater than 5.0 mPa·s, even more preferably no greater than 4.8 mPa·s and most preferably no greater than 4.7 mPa·s. It is also preferably 3.0 mPa·s or greater, even more preferably 3.5 mPa·s or greater, yet more preferably 4.0 mPa·s or greater and most preferably 4.2 mPa·s or greater. The HTHS viscosity at 100° C., according to the invention, is the high-temperature high-shear viscosity at 100° C. according to ASTM D4683. If the HTHS viscosity at 100° C. is less than 3.0 mPa·s, insufficient lubricity may result, and if it is greater than 5.5 mPa·s it may not be possible to obtain the necessary low-temperature viscosity and sufficient fuel efficiency performance.

The HTHS viscosity at 150° C. of the lubricating oil composition of the first embodiment is preferably no greater than 3.5 mPa·s, more preferably no greater than 3.0 mPa·s, even more preferably no greater than 2.8 mPa·s and most preferably no greater than 2.7 mPa·s. It is also preferably 2.0 mPa·s or greater, more preferably 2.3 mPa·s or greater, even more preferably 2.4 mPa·s or greater, yet more preferably 2.5 mPa·s or greater and most preferably 2.6 mPa·s or greater. The HTHS viscosity at 150° C., according to the invention, is the high-temperature high-shear viscosity at 150° C. according to ASTM D4683. If the HTHS viscosity at 150° C. is less than 2.0 mPa·s, insufficient lubricity may result, and if it is greater than 3.5 mPa·s it may not be possible to obtain the necessary low-temperature viscosity and sufficient fuel efficiency performance.

Also, the ratio of the HTHS viscosity at 150° C. and the HTHS viscosity at 100° C. of the lubricating oil composition of the first embodiment (HTHS viscosity at 150° C./HTHS viscosity at 100° C.) is preferably 0.50 or greater, more preferably 0.52 or greater, even more preferably 0.54, yet more preferably 0.55 or greater and most preferably 0.56 or greater. If the ratio is less than 0.50, it may not be possible to obtain the necessary low-temperature viscosity and sufficient fuel efficiency performance.

The lubricating oil composition of the first embodiment has excellent fuel efficiency and lubricity, and is effective for improving fuel efficiency while maintaining a constant level for the HTHS viscosity at 150° C., even without using a synthetic oil such as a poly-α-olefinic base oil or esteric base oil or a low-viscosity mineral base oil, because it reduces the 40° C. and kinematic viscosity at 100° C. and the HTHS viscosity at 100° C. of lubricating oils. The lubricating oil composition of the first embodiment having such superior properties can be suitably employed as a fuel efficient engine oil, such as a fuel efficient gasoline engine oil or fuel efficient diesel engine oil.

[Second Embodiment]

The lubricating oil composition of the second embodiment of the invention comprises a lubricating base oil comprising a first lubricating base oil component having a urea adduct value of no greater than 5% by mass, a kinematic viscosity at 40° C. of at least 14 $mm^2/s$ and no greater than 25 $mm^2/s$ and a viscosity index of 120 or greater, and a second lubricating base oil component having a kinematic viscosity at 40° C. of 5 $mm^2/s$ or greater and less than 14 $mm^2/s$, wherein the first lubricating base oil component content is 10-99% by mass and the second lubricating base oil component content is 1-50% by mass, based on the total weight of the lubricating base oil, and a viscosity index improver having a ratio M1/M2 of 0.20 or greater, between the total area of the peaks between chemical shifts of 36-38 ppm M1 and the total area of the peaks between chemical shifts of 64-66 ppm M2, with respect to the total area of all of the peaks in the spectrum obtained by $^{13}C$-NMR.

(Lubricating Base Oil)

So long as the first lubricating base oil component has a urea adduct value, kinematic viscosity at 40° C. and viscosity index satisfying the aforementioned conditions, it may be a mineral base oil, a synthetic base oil, or even a mixture thereof.

The first lubricating base oil component is preferably a mineral base oil or synthetic base oil, or a mixture thereof, obtained by hydrocracking/hydroisomerization of a stock oil containing normal paraffins, to a urea adduct value of no greater than 5% by mass, a kinematic viscosity at 40° C. of between 14 $mm^2/s$ and 25 $mm^2/s$ and a viscosity index of 120 or higher, since this will allow all of the requirements for the viscosity-temperature characteristic, low-temperature viscosity characteristic and thermal conductivity to be achieved at high levels.

From the viewpoint of improving the low-temperature viscosity characteristic without impairing the viscosity-temperature characteristic, and obtaining high thermal conductivity, the urea adduct value of the first lubricating base oil component is preferably no greater than 5% by mass as mentioned above, and is more preferably no greater than 4.0% by mass, even more preferably no greater than 3.5% by mass, yet more preferably no greater than 3.0% by mass, even yet more preferably no greater than 2.5% by mass and most preferably no greater than 2.0% by mass. The urea adduct value of the first lubricating base oil component may even be 0% by mass, but from the viewpoint of obtaining a lubricating base oil with a sufficient low-temperature viscosity characteristic and high viscosity index, and also of relaxing the dewaxing conditions and improving economy, it is preferably 0.1% by mass or greater, more preferably 0.5% by mass or greater and most preferably 0.8% by mass or greater.

The kinematic viscosity at 40° C. of the first lubricating base oil component is preferably 14-25 $mm^2/s$, more preferably 14.5-20 $mm^2/s$, even more preferably 15-19 $mm^2/s$, yet more preferably 15-18 $mm^2/s$, even yet more preferably 15-17 $mm^2/s$ and most preferably 15-16.5 $mm^2/s$. If the kinematic viscosity at 40° C. of the first lubricating base oil component exceeds 25 $mm^2/s$, the low-temperature viscosity characteristic may be impaired and sufficient fuel efficiency may not be obtained, while if the kinematic viscosity at 40° C. of the first lubricating base oil component is less than 14 $mm^2/s$, oil film formation at the lubricated sections will be inadequate, resulting in inferior lubricity and potentially large evaporation loss of the lubricating oil composition.

The value of the viscosity index of the first lubricating base oil component is preferably 120 or greater, more preferably 125 or greater, even more preferably 130 or greater, yet more preferably 135 or greater and most preferably 140 or greater, in order to obtain an excellent viscosity characteristic from low temperature to high temperature, and for resistance to evaporation even at low viscosity. There are no particular restrictions on the upper limit for the viscosity index, and it may be about 125-180 such as for normal paraffins, slack waxes or GTL waxes, or their isomerized isoparaffin-based mineral oils, or about 150-250 such as for complex esteric base oils or HVI-PAO base oils. However, for normal paraffins, slack waxes or GTL waxes, or their isomerized isoparaffin-based mineral oils, it is preferably no higher than 180, more preferably no higher than 170, even more preferably no higher than 160 and especially no higher than 155, for an improved low-temperature viscosity characteristic.

A stock oil containing normal paraffins may be used for production of the first lubricating base oil component. The stock oil may be a mineral oil or a synthetic oil, or a mixture of two or more thereof. The normal paraffin content of the stock oil is preferably 50% by mass or greater, more preferably 70% by mass or greater, even more preferably 80% by mass or greater, yet more preferably 90% by mass, even yet more preferably 95% by mass or greater and most preferably 97% by mass or greater, based on the total weight of the stock oil.

As examples of wax-containing starting materials there may be mentioned oils derived from solvent refining methods, such as raffinates, partial solvent dewaxed oils, depitched oils, distillates, reduced pressure gas oils, coker gas oils, slack waxes, foot oil, Fischer-Tropsch waxes and the like, among which slack waxes and Fischer-Tropsch waxes are preferred.

Slack wax is typically derived from hydrocarbon starting materials by solvent or propane dewaxing. Slack waxes may contain residual oil, but the residual oil can be removed by deoiling. Foot oil corresponds to deoiled slack wax.

Fischer-Tropsch waxes are produced by so-called Fischer-Tropsch synthesis.

Stock oil from solvent extraction is obtained by feeding a high boiling point petroleum fraction from atmospheric distillation to a vacuum distillation apparatus and subjecting the distillation fraction to solvent extraction. The residue from vacuum distillation may also be depitched. In solvent extraction methods, the aromatic components are dissolved in the extract phase while leaving more paraffinic components in the raffinate phase. Naphthenes are distributed in the extract phase and raffinate phase. The preferred solvents for solvent extraction are phenols, furfurals and N-methylpyrrolidone. By controlling the solvent/oil ratio, extraction temperature and method of contacting the solvent with the distillate to be extracted, it is possible to control the degree of separation between the extract phase and raffinate phase. There may also be used as the starting material a bottom fraction obtained from a fuel oil hydrocracking apparatus, using a fuel oil hydrocracking apparatus with higher hydrocracking performance.

The first lubricating base oil component may be obtained through a step of hydrocracking/hydroisomerization of the stock oil until the obtained treatment product has a urea adduct value, a kinematic viscosity at 40° C., a viscosity index and a T90-T10 satisfying the conditions specified above. The hydrocracking/hydroisomerization step is not particularly restricted so long as it satisfies the aforementioned conditions for the urea adduct value and viscosity index of the treatment product. A preferred hydrocracking/hydroisomerization step according to the invention comprises:

a first step in which a normal paraffin-containing stock oil is subjected to hydrocracking using a hydrocracking catalyst, a second step in which the treatment product from the first step is subjected to hydrodewaxing using a hydrodewaxing catalyst, and a third step in which the treatment product from the second step is subjected to hydrorefining using a hydrorefining catalyst. The treatment product obtained after the third step may also be subjected to distillation or the like as necessary for separating removal of certain components.

The first lubricating base oil component obtained by the production method described above is not particularly restricted in terms of its other properties so long as the urea adduct value, 40° C. viscosity and viscosity index satisfy their respective conditions, but the first lubricating base oil component preferably also satisfies the conditions specified below.

The kinematic viscosity at 100° C. of the first lubricating base oil component is preferably no greater than 5.0 $mm^2/s$, more preferably no greater than 4.5 $mm^2/s$, even more preferably no greater than 4.3 $mm^2/s$, yet more preferably no greater than 4.2 $mm^2/s$, even yet more preferably no greater than 4.0 $mm^2/s$ and most preferably no greater than 3.9 $mm^2/s$. On the other hand, the kinematic viscosity at 100° C. is also preferably 2.0 $mm^2/s$ or greater, more preferably 3.0 $mm^2/s$ or greater, even more preferably 3.5 $mm^2/s$ or greater and most preferably 3.7 $mm^2/s$ or greater. If the kinematic viscosity at 100° C. of the lubricating base oil component exceeds 5.0 $mm^2/s$, the low-temperature viscosity characteristic may be impaired and sufficient fuel efficiency may not be obtained, while if it is 2.0 $mm^2/s$ or lower, oil film formation at the lubricated sections will be inadequate, resulting in inferior lubricity and potentially large evaporation loss of the lubricating oil composition.

The pour point of the first lubricating base oil component will depend on the viscosity grade of the lubricating base oil, but it is preferably no higher than −10° C., more preferably no higher than −12.5° C., even more preferably no higher than −15° C., most preferably no higher than −17.5° C., and especially preferably no higher than −20° C. If the pour point exceeds the upper limit specified above, the low-temperature flow properties of the lubricating oil employing the lubricating base oil component may be reduced. The pour point of the first lubricating base oil component is also preferably −50° C. or higher, more preferably −40° C. or higher, even more preferably −30° C. or higher and most preferably −25° C. or higher. If the pour point is below this lower limit, the viscosity index of the entire lubricating oil employing the lubricating base oil component will be reduced, potentially impairing the fuel efficiency.

The iodine value of the first lubricating base oil component is preferably no greater than 1, more preferably no greater than 0.5, even more preferably no greater than 0.3, yet more preferably no greater than 0.15 and most preferably no greater than 0.1. Although the value may be less than 0.01, in consideration of the fact that this does not produce any further significant corresponding effect and is uneconomical, the value is preferably 0.001 or greater, more preferably 0.01 or greater, even more preferably 0.03 or greater and most preferably 0.05 or greater. Limiting the iodine value of the lubricating base oil component to no greater than 0.5 can drastically improve the heat and oxidation stability.

The sulfur content of the first lubricating base oil component is not particularly restricted but is preferably no greater than 50 ppm by mass, more preferably no greater than 10 ppm by mass, even more preferably no greater than 5 ppm by mass and most preferably no greater than 1 ppm by mass. A sulfur content of no greater than 50 ppm by mass will allow excellent heat and oxidation stability to be achieved.

The evaporation loss of the first lubricating base oil component is preferably no greater than 25% by mass, more preferably no greater than 21 and even more preferably no greater than 18% by mass, as the NOACK evaporation. If the NOACK evaporation of the lubricating base oil component exceeds 25% by mass, the evaporation loss of the lubricating oil will increase, resulting in increased viscosity and the like, and this is therefore undesirable. The NOACK evaporation according to the invention is the evaporation of the lubricating oil measured according to ASTM D 5800.

As regards the distillation properties of the first lubricating base oil component, the initial boiling point (IBP) is preferably 320-390° C., more preferably 330-380° C. and even more preferably 340-370° C. The 10% distillation temperature (T10) is preferably 370-430° C., more preferably 380-420° C. and even more preferably 390-410° C. The 50% running point (T50) is preferably 400-470° C., more preferably 410-460° C. and even more preferably 420-450° C. The 90% running point (T90) is preferably 430-500° C., more preferably 440-490° C. and even more preferably 450-480° C. The final boiling point (FBP) is preferably 450-520° C., more preferably 460-510° C. and even more preferably 470-500° C.

As regards the distillation properties of the first lubricating base oil component, T90-T10 is preferably 30-90° C., more preferably 40-80° C. and even more preferably 50-70° C. FBP-IBP is preferably 90-150° C., more preferably 100-140° C. and even more preferably 110-130° C. T10-IBP is preferably 10-60° C., more preferably 20-50° C. and even more preferably 30-40° C. FBP-T90 is preferably 5-60° C., more preferably 10-45° C. and even more preferably 15-35° C.

By setting IBP, T10, T50, T90, FBP, T90-T10, FBP-IBP, T10-IBP and FBP-T90 of the first lubricating base oil component to within the preferred ranges specified above, it is possible to further improve the low-temperature viscosity and further reduce the evaporation loss. If the distillation ranges for T90-T10, FBP-IBP, T10-IBP and FBP-T90 are too narrow, the lubricating base oil yield will be poor resulting in low economy.

The % $C_p$ value of the first lubricating base oil component of the second embodiment is preferably 80 or greater, more preferably 82-99, even more preferably 85-98 and most preferably 90-97. If the % $C_p$ value of the lubricating base oil is less than 80, the viscosity-temperature characteristic, heat and oxidation stability and frictional properties will tend to be reduced, while the efficacy of additives when added to the lubricating base oil will also tend to be reduced. If the % $C_p$ value of the lubricating base oil is greater than 99, on the other hand, the additive solubility will tend to be lower.

The % $C_N$ value of the first lubricating base oil component of the second embodiment is preferably no greater than 20, more preferably no greater than 15, even more preferably 1-12 and most preferably 3-10. If the % $C_N$ value of the lubricating base oil exceeds 20, the viscosity-temperature characteristic, heat and oxidation stability and frictional properties will tend to be reduced. If the % $C_N$ is less than 1, however, the additive solubility will tend to be lower.

The % $C_A$ value of the first lubricating base oil component of the second embodiment is preferably no greater than 0.7, more preferably no greater than 0.6 and even more preferably 0.1-0.5. If the % $C_A$ value of the lubricating base oil exceeds 0.7, the viscosity-temperature characteristic, heat and oxidation stability and frictional properties will tend to be reduced. The % $C_A$ value of the lubricating base oil of the second embodiment may be zero, but the solubility of additives can be further increased with a % $C_A$ value of 0.1 or greater.

The ratio of the % $C_P$ and % $C_N$ values for the first lubricating base oil component of the second embodiment is a % $C_P$% $C_N$ ratio of preferably 7 or greater, more preferably 7.5 or greater and even more preferably 8 or greater. If the % $C_P$% $C_N$ ratio is less than 7, the viscosity-temperature characteristic, heat and oxidation stability and frictional properties will tend to be reduced, while the efficacy of additives when added to the lubricating base oil will also tend to be reduced. The % $C_P$% $C_N$ ratio is preferably no greater than 200, more preferably no greater than 100, even more preferably no greater than 50 and most preferably no greater than 25. The additive solubility can be further increased if the % $C_P$% $C_N$ ratio is no greater than 200.

For the lubricating oil composition of the second embodiment, the first lubricating base oil component may be a single lubricating base oil having a urea adduct value of no greater than 5% by mass, a kinematic viscosity at 40° C. of 14-25 $mm^2/s$ and a viscosity index or 120 or higher, or it may be a combination of two or more different ones.

The content ratio of the first lubricating base oil component is 10-99% by mass, preferably 30-95% by mass, more preferably 50-90% by mass, even more preferably 60-85% by mass and most preferably 65-80% by mass, based on the total weight of the lubricating base oil. If the content ratio is less than 10% by mass, it may not be possible to obtain the necessary low-temperature viscosity and fuel efficiency performance.

The lubricating oil composition of the second embodiment comprises, as a constituent component of the lubricating base oil, a second lubricating base oil component having a kinematic viscosity at 40° C. of less than 5-14 $mm^2/s$.

The second lubricating base oil component is not particularly restricted so long as it satisfies the aforementioned conditions, but mineral base oils include solvent refined mineral oil, hydrocracked mineral oil, hydrorefined mineral oil, solvent dewaxed base oil and the like.

As synthetic base oils there may be mentioned poly-α-olefins and their hydrogenated forms, isobutene oligomers and their hydrogenated forms, isoparaffins, alkylbenzenes, alkylnaphthalenes, diesters (ditridecyl glutarate, di-2-ethylhexyl adipate, diisodecyl adipate, ditridecyl adipate, di-2-ethylhexyl sebacate and the like), polyol esters (trimethylolpropane caprylate, trimethylolpropane pelargonate, pentaerythritol 2-ethylhexanoate, pentaerythritol pelargonate and the like), polyoxyalkylene glycols, dialkyldiphenyl ethers and polyphenyl ethers, among which poly-α-olefins are preferred. Typical poly-α-olefins include C2-32 and preferably C6-16 α-olefin oligomers or co-oligomers (1-octene oligomer, decene oligomer, ethylene-propylene co-oligomers and the like), and their hydrides.

The kinematic viscosity at 40° C. of the second lubricating base oil component is preferably less than 14 $mm^2/s$, and it is more preferably no greater than 13 $mm^2/s$, even more preferably no greater than 12 $mm^2/s$, yet more preferably no greater than 11 $mm^2/s$ and most preferably no greater than 10 $mm^2/s$. On the other hand, the kinematic viscosity at 40° C. is preferably 5 $mm^2/s$ or greater, more preferably 6 $mm^2/s$ or greater, even more preferably 7 $mm^2/s$ or greater, yet more preferably 8 $mm^2/s$ or greater and most preferably 9 $mm^2/s$ or greater. If the kinematic viscosity at 40° C. is less than 5 $mm^2/s$, problems in terms of oil film retention and evaporation may occur at lubricated sections, which is undesirable. If the kinematic viscosity at 40° C. is 14 $mm^2/s$ or higher, a combined effect with the first lubricating base oil component will not be obtained.

From the viewpoint of the viscosity-temperature characteristic, the viscosity index of the second lubricating base oil component is preferably 80 or greater, more preferably 100 or greater, even more preferably 110 or greater, yet more preferably 120 or greater and most preferably 128 or greater, preferably no greater than 150, more preferably no greater than 140 and even more preferably no greater than 135. If the viscosity index is less than 80 it may not be possible to obtain effective energy efficiency, and this is undesirable. A viscosity index of no higher than 150 will allow a composition with an excellent low-temperature characteristic to be obtained.

The kinematic viscosity at 100° C. of the second lubricating base oil component is preferably no greater than 3.5 $mm^2/s$, more preferably no greater than 3.3 $mm^2/s$, even more preferably no greater than 3.1 $mm^2/s$, yet more preferably no greater than 3.0 $mm^2/s$, even yet more preferably no greater than 2.9 $mm^2/s$ and most preferably no greater than 2.8 $mm^2/s$. The kinematic viscosity at 100° C., on the other hand, is preferably 2 $mm^2/s$ or greater, more preferably 2.3 $mm^2/s$ or greater, even more preferably 2.4 $mm^2/s$ or greater and most preferably 2.5 $mm^2/s$ or greater. If the kinematic viscosity at 100° C. of the lubricating base oil is less than 2 $mm^2/s$ the evaporation loss may be too large, and if the kinematic viscosity at 100° C. exceeds 3.5 $mm^2/s$ the effect of improving the low-temperature viscosity characteristic may be reduced.

From the viewpoint of improving the low-temperature viscosity characteristic without impairing the viscosity-temperature characteristic, the urea adduct value of the second lubricating base oil component is preferably no greater than 4% by mass, more preferably no greater than 3.5% by mass, even more preferably no greater than 3% by mass and most preferably no greater than 2.5% by mass. The urea adduct value of the second lubricating base oil component may even be 0% by mass, but from the viewpoint of obtaining a lubricating base oil with a sufficient low-temperature viscosity characteristic, high viscosity index and high flash point, and also of relaxing the isomerization conditions and improving economy, it is preferably 0.1% by mass or greater, more preferably 0.5% by mass or greater and most preferably 1.0% by mass or greater.

The % $C_P$ value of the second lubricating base oil component is preferably 70 or greater, more preferably 82-99.9, even more preferably 85-98 and most preferably 90-97. If the % $C_p$ value of the second lubricating base oil component is less than 70, the viscosity-temperature characteristic, heat and oxidation stability and frictional properties will tend to be reduced, while the efficacy of additives when added to the lubricating base oil will also tend to be reduced. If the % $C_p$ value of the second lubricating base oil component is greater than 99, on the other hand, the additive solubility will tend to be lower.

The % $C_N$ value of the second lubricating base oil component is preferably no greater than 30, more preferably 1-15 and even more preferably 3-10. If the % $C_N$ value of the second lubricating base oil component exceeds 30, the viscosity-temperature characteristic, heat and oxidation stability and frictional properties will tend to be reduced. If the % $C_N$ is less than 1, however, the additive solubility will tend to be lower.

The % $C_A$ value of the second lubricating base oil component is preferably no greater than 0.7, more preferably no greater than 0.6 and even more preferably 0.1-0.5. If the % $C_A$ value of the second lubricating base oil component exceeds 0.7, the viscosity-temperature characteristic, heat and oxidation stability and frictional properties will tend to be reduced. The % $C_A$ value of the second lubricating base oil component may be zero, but the solubility of additives can be further increased with a % $C_A$ value of 0.1 or greater.

The ratio of the % $C_P$ and % $C_N$ values for the second lubricating base oil component is a % $C_P$% $C_N$ ratio of preferably 7 or greater, more preferably 7.5 or greater and even more preferably 8 or greater. If the % $C_P$% $C_N$ ratio is less than 7, the viscosity-temperature characteristic, heat and oxidation stability and frictional properties will tend to be reduced, while the efficacy of additives when added to the lubricating base oil will also tend to be reduced. The % $C_P$% $C_N$ ratio is preferably no greater than 200, more preferably no greater than 100, even more preferably no greater than 50 and most preferably no greater than 25. The additive solubility can be further increased if the % $C_P$% $C_N$ ratio is no greater than 200.

The iodine value of the second lubricating base oil component is not particularly restricted, but is preferably no greater than 6, more preferably no greater than 1, even more preferably no greater than 0.5, yet more preferably no greater than 0.3 and most preferably no greater than 0.15, and although it may be less than 0.01, it is preferably 0.001 or greater and more preferably 0.05 or greater in consideration of achieving a commensurate effect, and in terms of economy. Limiting the iodine value of the lubricating base oil component to no greater than 6 and especially no greater than 1 can drastically improve the heat and oxidation stability.

From the viewpoint of further improving the heat and oxidation stability and reducing sulfur, the sulfur content in the second lubricating base oil component is preferably no greater than 10 ppm by mass, more preferably no greater than 5 ppm by mass and even more preferably no greater than 3 ppm by mass.

From the viewpoint of cost reduction it is preferred to use slack wax or the like as the starting material, in which case the sulfur content of the obtained second lubricating base oil component is preferably no greater than 50 ppm by mass and more preferably no greater than 10 ppm by mass.

The nitrogen content in the second lubricating base oil component is not particularly restricted, but is preferably no greater than 5 ppm by mass, more preferably no greater than 3 ppm by mass and even more preferably no greater than 1 ppm by mass. If the nitrogen content exceeds 5 ppm by mass, the heat and oxidation stability will tend to be reduced.

The pour point of the second lubricating base oil component is preferably no higher than −25° C., more preferably no higher than −27.5° C. and even more preferably no higher than −30° C. If the pour point exceeds the upper limit specified above, the low-temperature flow property of the lubricating oil composition as a whole will tend to be reduced.

As regards the distillation properties of the second lubricating base oil component based on gas chromatography distillation, the initial boiling point (IBP) is preferably 285-325° C., more preferably 290-320° C. and even more preferably 295-315° C. The 10% distillation temperature (T10) is preferably 320-380° C., more preferably 330-370° C. and even more preferably 340-360° C. The 50% running point (T50) is preferably 375-415° C., more preferably 380-410° C. and even more preferably 385-405° C. The 90% running point (T90) is preferably 370-440° C., more preferably 380-430° C. and even more preferably 390-420° C. The final boiling point (FBP) is preferably 390-450° C., more preferably 400-440° C. and even more preferably 410-430° C. T90-T10 is preferably 25-85° C., more preferably 35-75° C. and even more preferably 45-65° C. FBP-IBP is preferably 70-150° C., more preferably 90-130° C. and even more preferably 90-120° C. T10-IBP is preferably 10-70° C., more preferably 20-60° C. and even more preferably 30-50° C. FBP-T90 is preferably 5-50° C., more preferably 10-45° C. and even more preferably 15-40° C.

By setting IBP, T10, T50, T90, FBP, T90-T10, FBP-IBP, T10-IBP and FBP-T90 of the second lubricating base oil component to within the preferred ranges specified above, it is possible to further improve the low-temperature viscosity and further reduce the evaporation loss. If the distillation ranges for T90-T10, FBP-IBP, T10-IBP and FBP-T90 are too narrow, the lubricating base oil yield will be poor resulting in low economy.

According to the invention, the content of the second lubricating base oil component is 1% by mass-50% by mass, preferably 10-48% by mass, more preferably 12-45% by mass, even more preferably 15-40% by mass and most preferably 18-36% by mass, based on the total weight of the lubricating base oil. If the content ratio is less than 1% by mass it may not be possible to obtain the necessary low-temperature viscosity and fuel efficiency performance, while if it exceeds 50% by mass the evaporation loss of the lubricating oil will increase, potentially resulting in increased viscosity and the like.

The lubricating base oil used for the second embodiment may consist entirely of the first lubricating base oil component and second lubricating base oil component, but it may also comprise lubricating base oil components other than the first lubricating base oil component and second lubricating base oil component, and so long as the contents of the first lubricating base oil component and second lubricating base oil component are within the ranges specified above.

The kinematic viscosity at 40° C. of the lubricating base oil used for the second embodiment is preferably no greater than 20 $mm^2/s$, more preferably no greater than 16 $mm^2/s$, even more preferably no greater than 15 $mm^2/s$ and most preferably no greater than 14 $mm^2/s$, and also preferably 8 $mm^2/s$ or greater, more preferably 10 $mm^2/s$ or greater and even more preferably 12 $mm^2/s$ or greater.

The kinematic viscosity at 100° C. of the lubricating base oil used for the second embodiment is preferably no greater than 20 $mm^2/s$, more preferably no greater than 4.5 $mm^2/s$, even more preferably no greater than 3.8 $mm^2/s$, yet more preferably no greater than 3.7 $mm^2/s$ and most preferably no greater than 3.6 $mm^2/s$, and also 1 $mm^2/s$ or greater, more preferably 2.3 $mm^2/s$ or greater, even more preferably 2.8 $mm^2/s$ or greater and most preferably 3.3 $mm^2/s$ or greater. If the kinematic viscosity of the lubricating base oil is within the ranges specified above, it will be possible to obtain a base oil with a more excellent balance between evaporation loss and low-temperature viscosity characteristic.

The viscosity index of the lubricating base oil used for the second embodiment is preferably 100 or greater, more preferably 120 or greater, even more preferably 130 or greater and most preferably 135 or greater, and preferably no greater than 170, more preferably no greater than 150 and even more preferably no greater than 140. If the viscosity index is within this range it will be possible to obtain a base oil with an excellent viscosity-temperature characteristic, while a lubricating oil composition with a particularly high viscosity index and a notably superior low-temperature viscosity characteristic can be obtained.

In order to obtain a lubricating oil composition with an excellent balance between the low-temperature viscosity characteristic and evaporation loss, the NOACK evaporation of the lubricating base oil used for the second embodiment is preferably 10% by mass or greater, more preferably 16% by mass or greater, even more preferably 18% by mass or greater, even more preferably 20% by mass or greater and most preferably 21% by mass or greater, and preferably no greater than 30% by mass, more preferably no greater than 25% by mass and most preferably no greater than 23% by mass. In particular, by limiting the NOACK evaporation of the lubricating base oil to 21-23% by mass and adding the viscosity index improver and other lubricating oil additives at 10% by mass or greater, it is possible to obtain a lubricating oil composition with an excellent balance between low-temperature viscosity characteristic and evaporation loss, a high viscosity index, a lower HTHS viscosity at 100° C., and excellent fuel efficiency.

As regards the distillation properties of the lubricating base oil used for the second embodiment, the initial boiling point is preferably no higher than 370° C., more preferably no higher than 350° C., even more preferably no higher than 340° C. and most preferably no higher than 330° C., and preferably 260° C. or higher, more preferably 280° C. or higher and even more preferably 300° C. or higher. The 10% distillation temperature of the lubricating base oil is preferably no higher than 400° C., more preferably no higher than 390° C. and even more preferably no higher than 380° C., and preferably 320° C. or higher, more preferably 340° C. or higher and even more preferably 360° C. or higher. The 90% distillation temperature of the lubricating base oil is preferably 430° C. or higher, more preferably 435° C. or higher and even more preferably 440° C. or higher, and preferably no higher than 480° C., more preferably no higher than 470° C. and even more preferably no higher than 460° C. The final boiling point (FBP) of the lubricating base oil is preferably 440-520° C., more preferably 460-500° C. and even more preferably 470-490° C. Also, the difference between the 90% distillation temperature and 10% distillation temperature of the lubricating base oil is 50° C. or higher, more preferably 60° C. or higher, even more preferably 70° C. or higher and most preferably 75° C. or higher, and preferably no higher than 100° C., more preferably no higher than 90° C. and even more preferably no higher than 85° C. FBP-IBP for the lubricating base oil is preferably 135-200° C., more preferably 140-180° C. and even more preferably 150-170° C. T10-IBP is preferably 20-100° C., more preferably 40-90° C. and even more preferably 50-80° C. FBP-T90 is preferably 5-50° C., more preferably 10-40° C. and even more preferably 15-35° C. By setting IBP, T10, T50, T90, FBP, T90-T10, FBP-IBP, T10-IBP and FBP-T90 of the lubricating base oil to within the preferred ranges specified above, it is possible to further improve the low-temperature viscosity and further reduce the evaporation loss.

The lubricating base oil to be used for the second embodiment has a ratio of the kinematic viscosity at 100° C. (kv100) to T10 (kv100/T10, units: $mm^2s^{-1}/°$ C.) of preferably 0.007-0.015 and more preferably 0.008-0.0095. The lubricating base oil also has a ratio of the kinematic viscosity at 100° C. (kv100) to T50 (kv100/T50, units: $mm^2s^{-1}/°$ C.) of preferably 0.006-0.009 and more preferably 0.007-0.0085. If kv100/T10 or kv100/T50 is below the aforementioned lower limits the lubricating base oil yield will tend to be reduced, while it is also undesirable in terms of economy, and if it exceeds the aforementioned upper limits the evaporation properties of the lubricating oil composition will tend to increase relative to the obtained viscosity index.

The urea adduct value, the % $C_P$, % $C_A$, % $C_N$ and % $C_P$/% $C_N$ values and the sulfur and nitrogen contents of the lubricating base oil used for the second embodiment are determined by their values in the first lubricating base oil component and second lubricating base oil component or other addable lubricating base oil components, as well as on their content ratios, but they are preferably within the preferred ranges for the first lubricating base oil component and second lubricating base oil component.

The viscosity index improver that may be used for the second embodiment preferably has a ratio of at least 0.20 for M1/M2, as the ratio between the total area of the peaks between chemical shifts of 36-38 ppm M1 and the total area of the peaks between chemical shifts of 64-66 ppm M2, with respect to the total area of all of the peaks, in the spectrum obtained by nuclear magnetic resonance analysis ($^{13}$C-NMR). The specific and preferred modes of the viscosity index improver are the same as the specific and preferred modes of the viscosity index improver of the first embodiment, and their explanation will not be repeated here.

The lubricating oil composition of the second embodiment may further contain any additives commonly used in lubricating oils, for the purpose of enhancing performance. Examples of such additives include additives such as friction modifiers, metallic detergents, ash-free dispersants, antioxidants, anti-wear agents (or extreme-pressure agents), corrosion inhibitors, anti-rust agents, pour point depressants, demulsifiers, metal deactivators and antifoaming agents. The types and contents of these additives are the same as for the first embodiment and therefore will not be repeated here.

Either an organic molybdenum compound or an ash-free friction modifier alone may be used for the second embodiment, or both may be used together, but it is more preferred to use an ash-free friction modifier, and it is most preferred to use a fatty acid ester-based ash-free friction modifier such as glycerin oleate and/or a urea-based friction modifier such as oleylurea.

The kinematic viscosity at 100° C. of the lubricating oil composition of the second embodiment is preferably 4-12 $mm^2/s$, and the lower limit is preferably 4.5 $mm^2/s$ or greater, more preferably 5 $mm^2/s$ or greater, even more preferably 6 $mm^2/s$ or greater and most preferably 7 $mm^2/s$ or greater. The upper limit is preferably no greater than 11 $mm^2/s$, more preferably no greater than 10 $mm^2/s$, even more preferably no greater than 9 $mm^2/s$ and most preferably no greater than 8 $mm^2/s$. If the kinematic viscosity at 100° C. is less than 4 $mm^2/s$, insufficient lubricity may result, and if it is greater than 12 $mm^2/s$ it may not be possible to obtain the necessary low-temperature viscosity and sufficient fuel efficiency performance.

The viscosity index of the lubricating oil composition of the second embodiment is preferably in the range of 200-350, more preferably 210-300, even more preferably 220-300, yet more preferably 240-300 and most preferably 260-300. If the viscosity index of the lubricating oil composition of the second embodiment is less than 200 it may be difficult to maintain the HTHS viscosity while improving fuel efficiency, and it may also be difficult to lower the −35° C. low-temperature viscosity. In addition, if the viscosity index of the lubricating oil composition of the second embodiment is 350 or greater, the low-temperature flow property may be poor and problems may occur due to solubility of the additives or lack of compatibility with the sealant material.

The lubricating oil composition of the second embodiment preferably satisfies the following conditions, in addition to satisfying the aforementioned conditions for the kinematic viscosity at 100° C. and viscosity index.

The kinematic viscosity at 40° C. of the lubricating oil composition of the second embodiment is preferably 4-50 $mm^2/s$, and it is preferably no greater than 45 $mm^2/s$, more preferably no greater than 40 $mm^2/s$, even more preferably no greater than 35 $mm^2/s$, yet more preferably no greater than 30 $mm^2/s$ and most preferably no greater than 27 $mm^2/s$. On the other hand, the kinematic viscosity at 40° C. is preferably 5 $mm^2/s$ or greater, more preferably 10 $mm^2/s$ or greater, even more preferably 15 or greater and most preferably 20 or greater. If the kinematic viscosity at 40° C. is less than 4 $mm^2/s$, insufficient lubricity may result, and if it is greater than 50 $mm^2/s$ it may not be possible to obtain the necessary low-temperature viscosity and sufficient fuel efficiency performance.

The HTHS viscosity at 100° C. of the lubricating oil composition of the second embodiment is preferably no greater than 6.0 mPa·s, more preferably no greater than 5.5 mPa·s, even more preferably no greater than 5.3 mPa·s, yet more preferably no greater than 5.0 mPa·s and most preferably no greater than 4.5 mPa·s. It is also preferably 3.0 mPa·s or greater, preferably 3.5 mPa·s or greater, more preferably 3.8 mPa·s or greater, even more preferably 4.0 mPa·s or greater and most preferably 4.2 mPa·s or greater. If the HTHS viscosity at 100° C. is less than 3.0 mPa·s, the evaporation property may be high and insufficient lubricity may result, and if it is greater than 6.0 mPa·s it may not be possible to obtain the necessary low-temperature viscosity and sufficient fuel efficiency performance.

The HTHS viscosity at 150° C. of the lubricating oil composition of the second embodiment is preferably no greater than 3.5 mPa·s, more preferably no greater than 3.0 mPa·s, even more preferably no greater than 2.8 mPa·s and most preferably no greater than 2.7 mPa·s. It is also preferably 2.0 mPa·s or greater, more preferably 2.3 mPa·s or greater, even more preferably 2.4 mPa·s or greater, yet more preferably 2.5 mPa·s or greater and most preferably 2.6 mPa·s or greater. If the HTHS viscosity at 150° C. is less than 2.0 mPa·s, the evaporation property may be high and insufficient lubricity may result, and if it is greater than 3.5 mPa·s it may not be possible to obtain the necessary low-temperature viscosity and sufficient fuel efficiency performance.

Also, the ratio of the HTHS viscosity at 100° C. with respect to the HTHS viscosity at 150° C. in the lubricating oil composition of the second embodiment preferably satisfies the condition represented by the following inequality (A).

$$\text{HTHS}(100°\text{ C.})/\text{HTHS}(150°\text{ C.}) \leq 2.04 \quad \text{(A)}$$

wherein HTHS (100° C.) represents the HTHS viscosity at 100° C. and HTHS (150° C.) represents the HTHS viscosity at 150° C.

The HTHS (100° C.)/HTHS (150° C.) ratio is preferably no greater than 2.04 as mentioned above, and it is more preferably no greater than 2.00, even more preferably no greater than 1.98, yet more preferably no greater than 1.80 and most preferably no greater than 1.70. If HTHS (100° C.)/HTHS (150° C.) is greater than 2.04, it may not be possible to obtain sufficient fuel efficiency performance or low-temperature characteristics. Also, HTHS (100° C.)/HTHS (150° C.) is preferably 0.50 or greater, more preferably 0.70 or greater, even more preferably 1.00 or greater and most preferably 1.30 or greater. If HTHS (100° C.)/HTHS (150° C.) is less than 0.50, the cost of the base material may be drastically increased and solubility of the additives may not be achieved.

The lubricating oil composition of the second embodiment, having such a construction, is superior in terms of fuel efficiency, low evaporation property and low-temperature viscosity characteristic, and can exhibit fuel efficiency and both NOACK evaporation and low-temperature viscosity at −35° C. and below while maintaining HTHS viscosity at 150° C., even without using a synthetic oil such as a poly-α-olefinic base oil or esteric base oil, or a low-viscosity mineral base oil, and in particular it can reduce the 40° C. and kinematic viscosity at 100° C. and the HTHS viscosity at 100° C., while also notably improving the −35° C. CCS viscosity (−40° C. MR viscosity), of the lubricating oil. For example, with the lubricating oil composition of the second embodiment it is possible to obtain a −35° C. CCS viscosity of no greater than 2500 mPa·s, and especially no greater than 2300 mPa·s. Also, with the lubricating oil composition of the second embodiment it is possible to obtain a −40° C. MR viscosity of no greater than 8000 mPa·s, and especially no greater than 6000 mPa·s.

There are no particular restrictions on the use of the lubricating oil composition of the second embodiment, and it may be suitably used as a fuel efficient engine oil, fuel efficient gasoline engine oil or fuel efficient diesel engine oil.

EXAMPLES

The present invention will now be explained in greater detail based on examples and comparative examples, with the understanding that these examples are in no way limitative on the invention.

Examples 1-1 to 1-5

Comparative Examples 1-1 to 1-2

For Examples 1-1 to 1-5 and Comparative Examples 1-1 to 1-2 there were prepared lubricating oil compositions having the compositions shown in Table 2, using the base oils and additives listed below. The properties of base oils O-1-1 and O-1-2 are shown in Table 1.

(Base Oils)

O-1-1 (Base oil 1): Mineral oil obtained by hydrocracking/hydroisomerization of n-paraffin-containing oil O-1-2 (Base oil 2): Hydrocracked mineral oil (Additives)

A-1-1: Polymethacrylate (M1 =0.60, M2 =0.95, M1/M2 =0.64, ΔKV40/ΔKV100 =2.2, ΔHTHS100/ΔHTHS150 =1.51, MW=400,000, PSSI=20, Mw/Mn=2.2, Mw/PSSI=20,000)

A-1-2: Dispersant polymethacrylate (M1=0.46, M2 =3.52, M1/M2 =0.13, ΔKV40/ΔKV100 =3.3, ΔHTHS100/ΔHTHS150 =1.79, MW=300,000, PSSI=40, Mw/Mn=4.0, Mw/PSSI=7500)

A-1-3: Non-dispersant polymethacrylate (M1 =0.61, M2 =3.69, M1/M2 =0.17, ΔKV40/ΔKV100 =4.4, ΔHTHS100/ΔHTHS150 =2.15, MW=80,000, Mw/Mn=2.7, PSSI=5, Mw/PSSI=16,000)

B-1-1: Non-dispersant polymethacrylate (methacrylate copolymer with

C12-18 alkyl groups, Mw=60,000, PSSI=0.1)

B-1-2: Non-dispersant polymethacrylate (methacrylate copolymer with

C12-18 alkyl groups, Mw=50,000, PSSI=0.1)

C-1-1: Glycerin monooleate

C-1-2: Oleylurea

C-1-3: Molybdenum dithiocarbamate

D-1-1: Metallic detergent, ash-free dispersant, antioxidant, anti-wear agent, pour point depressant, antifoaming agent, etc.

TABLE 1

| | | | Base oil 1 | Base oil 2 |
|---|---|---|---|---|
| Density (15° C.) | | g/cm$^3$ | 0.820 | 0.8388 |
| Kinematic viscosity (40° C.) | | mm$^2$/s | 15.8 | 18.72 |
| Kinematic viscosity (100° C.) | | mm$^2$/s | 3.854 | 4.092 |
| Viscosity index | | | 141 | 120 |
| Pour point | | ° C. | −22.5 | −22.5 |
| Aniline point | | ° C. | 118.5 | 111.6 |
| Iodine value | | | 0.06 | 0.79 |
| Sulfur content | | ppm by mass. | <1 | 2 |
| Nitrogen content | | ppm by mass. | <3 | <3 |
| n-d-M Analysis | % $C_P$ | | 93.3 | 78 |
| | % $C_N$ | | 6.7 | 20.7 |
| | % $C_A$ | | 0 | 1.3 |
| Chromatographic separation | Saturated content | % by mass | 99.6 | 95.1 |
| | Aromatic content | % by mass | 0.2 | 4.7 |
| | Resin content | % by mass | 0.1 | 0.2 |
| Paraffin content based on saturated components | | % by mass | 87.1 | 50.6 |
| Naphthene content based on saturated components | | % by mass | 12.9 | 49.4 |
| Distillation properties | IBP | ° C. | 363.0 | 324.6 |
| | 0.1 | ° C. | 396.0 | 383.4 |
| | 0.5 | ° C. | 432.0 | 420.1 |
| | 0.9 | ° C. | 459.0 | 457.8 |
| | FBP | ° C. | 489.0 | 494.7 |

[Evaluation of Lubricating Oil Composition]

Each of the lubricating oil compositions of Examples 1-5 and

Comparative Examples 1 and 2 was measured for 40° C. or kinematic viscosity at 100° C., viscosity index, 100° C. or HTHS viscosity at 150° C. and −40° C. MR viscosity. The physical property values were measured by the following evaluation methods. The results are shown in Table 2.

(1) Kinematic viscosity: ASTM D-445
(2) Viscosity index: JIS K 2283-1993
(3) HTHS viscosity: ASTM D-4683
(4) MR viscosity: ASTM D-4684

TABLE 2

| | | | Ex. 1-1 | Ex. 1-2 | Ex. 1-3 | Ex. 1-4 | Ex. 1-5 | Comp. Ex. 1-1 | Comp. Ex. 1-2 |
|---|---|---|---|---|---|---|---|---|---|
| Base oil | Based on total base oil | | | | | | | | |
| O-1-1 | Base oil 1 | % by mass | 70 | 70 | 70 | 0 | 0 | 0 | 0 |
| O-1-2 | Base oil 2 | % by mass | 30 | 30 | 30 | 100 | 100 | 100 | 100 |
| Additive | Based on total composition | | | | | | | | |
| A-1-1 | Polymethacrylate | % by mass | 11.4 | 11.4 | 11.6 | 10.7 | 10.7 | | |
| A-1-2 | Polymethacrylate | % by mass | | | | | | 4.8 | |
| A-1-3 | Polymethacrylate | % by mass | | | | | | | 5.3 |
| B-1-1 | Polymethacrylate | % by mass | 0.3 | | 0.3 | 0.3 | | 0.3 | |
| B-1-2 | Polymethacrylate | % by mass | | 0.5 | | | | | |
| C-1-1 | Friction modifier 1 | % by mass | 0.5 | 0.5 | | 0.5 | 0.5 | 0.5 | 0.5 |
| C-1-2 | Friction modifier 2 | % by mass | 0.3 | 0.3 | | 0.3 | 0.3 | 0.3 | 0.3 |
| C-1-3 | Friction modifier 3 | % by mass | | | 0.5 | | | | |
| C-1-1 | Other additives | % by mass | 11.5 | 11.5 | 11.5 | 11.5 | 11.5 | 11.5 | 11.5 |
| Evaluation results | | | | | | | | | |
| Kinematic viscosity | 40° C. | $mm^2/s$ | 30.2 | 31.0 | 29.8 | 33.3 | 33.6 | 40.8 | 37.9 |
| | 100° C. | $mm^2/s$ | 7.5 | 7.6 | 7.4 | 7.7 | 7.8 | 8.8 | 7.7 |
| Viscosity index | | | 229 | 229 | 231 | 214 | 214 | 202 | 177 |
| HTHS viscosity | 100° C. | mPa · s | 4.6 | 4.6 | 4.6 | 4.8 | 4.8 | 5.3 | 5.3 |
| | 150° C. | mPa · s | 2.6 | 2.6 | 2.6 | 2.6 | 2.6 | 2.6 | 2.6 |
| MRV viscosity | −40° C. | mPa · s | 9000 | 9200 | 8900 | 21500 | presence of yield stress | — | 35600 |

As shown in Table 2, the lubricating oil compositions of Examples 1-1 to 1-5 and Comparative Examples 1-1 and 1-2 had approximately equivalent 150° C. HTHS viscosities, but the lubricating oil compositions of Examples 1 to 5 using viscosity index improvers with M1/M2 ratios of 0.2 or greater had lower 40° C. dynamic viscosities, 100° C. HTHS viscosities, higher viscosity indexes and more satisfactory viscosity-temperature characteristics, than the lubricating oil compositions of Comparative Examples 1 and 2. These results demonstrate that the lubricating oil composition of the invention is a lubricating oil composition that has excellent fuel efficiency, and can improve fuel efficiency while maintaining high-temperature high-shear viscosity at 150° C., even without using a synthetic oil such as a poly-α-olefinic base oil or esteric base oil, or a low-viscosity mineral base oil, and in particular it can reduce the -HTHS viscosity at 100° C. and also improve the −40° C. MR viscosity of lubricating oils.

Examples 2-1 to 2-5

Comparative Example 2-1

[Crude Wax]

The fraction separated by vacuum distillation in a process for refining of a solvent refined base oil was subjected to solvent extraction with furfural and then hydrocracking, which was followed by solvent dewaxing with a methyl ethyl ketone-toluene mixed solvent. The properties of the wax portion removed during solvent dewaxing and obtained as slack wax (hereunder, "WAX1") are shown in Table 3.

TABLE 3

| | |
|---|---|
| Name of crude wax | WAX1 |
| Kinematic viscosity at 100° C., $mm^2/s$ | 6.3 |
| Melting point, ° C. | 53 |

TABLE 3-continued

| | |
|---|---|
| Oil content, % by mass | 19.9 |
| Sulfur content, ppm by mass. | 1900 |

The properties of the wax portion obtained by further deoiling of WAX1 (hereunder, "WAX2") are shown in Table 4.

TABLE 4

| | |
|---|---|
| Name of crude wax | WAX2 |
| Kinematic viscosity at 100° C., $mm^2/s$ | 6.8 |
| Melting point, ° C. | 58 |
| Oil content, % by mass | 6.3 |
| Sulfur content, ppm by mass. | 900 |

An FT wax having a paraffin content of 95% by mass and a carbon number distribution from 20 to 80 (hereunder, "WAX3") was used, and the properties of WAX3 are shown in Table 5.

TABLE 5

| | |
|---|---|
| Name of crude wax | WAX3 |
| Kinematic viscosity at 100° C., $mm^2/s$ | 5.8 |
| Melting point, ° C. | 70 |
| Oil content, % by mass | <1 |
| Sulfur content, ppm by mass. | <0.2 |

[Production of Lubricating Base Oils]

WAX1, WAX2 and WAX3 were used as stock oils for hydrocracking with a hydrocracking catalyst. The reaction temperature and liquid space velocity were modified for a stock oil cracking severity of at least 5% by mass and a sulfur content of no greater than 10 ppm by mass in the oil to be treated. Here, a "stock oil cracking severity of at least 5% by mass" means that the proportion of the fraction lighter than the initial boiling point of the stock oil in the oil to be treated is at least 5% by mass with respect to the total stock oil weight, and this is confirmed by gas chromatography distillation.

Next, the treatment product obtained from the hydrocracking was subjected to hydrodewaxing in a temperature range of 315° C.-325° C. using a zeolite-based hydrodewaxing catalyst adjusted to a precious metal content of 0.1-5% by mass.

The treatment product (raffinate) obtained by this hydrodewaxing was subsequently treated by hydrorefining using a hydrorefining catalyst. Next, the lubricating base oils 1 to 4 were obtained by distillation, having the compositions and properties shown in Tables 6 and 7. Lubricating base oils 5 and 6 having the compositions and properties shown in Table 7 were also obtained as hydrotreated base oils obtained using WVGO as the stock oil. In Tables 6 and 7, the row headed "Proportion of normal paraffin-derived components in urea adduct" contains the values determined by gas chromatography of the urea adduct obtained during measurement of the urea adduct value (same hereunder).

A polymethacrylate-based pour point depressant (weight-average molecular weight: approximately 60,000) commonly used in automobile lubricating oils was added to the lubricating base oils listed in Tables 6 and 7. The pour point depressant was added in three different amounts of 0.3% by mass, 0.5% by mass and 1.0% by mass, based on the total weight of the composition. The −40° C. MR viscosity of each of the obtained lubricating oil compositions was then measured, and the obtained results are shown in Tables 6 and 7.

TABLE 6

| | | Base oil 1 | Base oil 2 | Base oil 3 |
|---|---|---|---|---|
| Stock oil | | WAX1 | WAX2 | WAX3 |
| Urea adduct value, % by mass | | 3.75 | 2.33 | 1.18 |
| Proportion of normal paraffin-derived components in urea adduct, % by mass | | 2.8 | 2.5 | 2.1 |
| Base oil composition (based on total base oil) | Saturated content, % by mass | 99.4 | 99.6 | 99.7 |
| | Aromatic content, % by mass | 0.4 | 0.3 | 0.2 |
| | Polar compound content, % by mass | 0.2 | 0.1 | 0.1 |
| Saturated compounds (based on total saturated content) | Cyclic saturated content, % by mass | 11.3 | 10.5 | 9.8 |
| | Acyclic saturated content, % by mass | 88.7 | 89.5 | 90.2 |
| Acyclic saturated compounds (based on total acyclic saturated portion) | Normal paraffins, % by mass | 0 | 0 | 0 |
| | Isoparaffins, % by mass | 100 | 100 | 100 |
| Sulfur content, ppm by mass. | | <1 | <10 | <10 |
| Nitrogen content, ppm by mass. | | <3 | <3 | <3 |
| Kinematic viscosity (40° C.), $mm^2/s$ | | 15.78 | 15.88 | 15.92 |
| Kinematic viscosity (100° C.), $mm^2/s$ | | 3.85 | 3.87 | 3.89 |
| Viscosity index | | 140 | 142 | 142 |
| Density (15° C.), $g/cm^3$ | | 0.8190 | 0.8188 | 0.8181 |
| Pour point, ° C. | | −22.5 | −22.5 | −25 |
| Freezing point, ° C. | | −24 | −25 | −26 |
| Iodine value | | 0.06 | 0.03 | 0.04 |
| Aniline point, ° C. | | 117.9 | 119.1 | 119.2 |
| Distillation properties, ° C. | IBP, ° C. | 364 | 364 | 363 |
| | T10, ° C. | 400 | 401 | 403 |
| | T50, ° C. | 437 | 438 | 436 |
| | T90, ° C. | 468 | 465 | 460 |
| | FBP, ° C. | 492 | 490 | 487 |
| CCS viscosity (−35° C.), mPa · s | | 1,550 | 1,510 | 1,470 |
| MRV viscosity (−40° C.), mPa · s | 0.3% by mass Pour point depressant | 7,300 | 5,600 | 5,200 |
| | 0.5% by mass Pour point depressant | 6,900 | 5,350 | 5,000 |
| | 1.0% by mass Pour point depressant | 7,200 | 5,700 | 5,600 |

TABLE 7

| | | Base oil 4 | Base oil 5 | Base oil 6 |
|---|---|---|---|---|
| Stock oil | | WAX2 | WVGO | WVGO |
| Urea adduct value, % by mass | | 3.33 | 5.8 | 5.3 |
| Proportion of normal paraffin-derived components in urea adduct, % by mass | | 2.5 | 4.85 | 1.8 |
| Base oil composition (based on total base oil) | Saturated content, % by mass | 99.4 | 99.6 | 99.9 |
| | Aromatic content, % by mass | 0.5 | 0.3 | 0.1 |
| | Polar compound content, % by mass | 0.2 | 0.1 | 0 |
| Saturated compounds (based on total saturated content) | Cyclic saturated content, % by mass | 12.5 | 49.9 | 45.6 |
| | Acyclic saturated content, % by mass | 87.5 | 50.1 | 54.4 |

TABLE 7-continued

| | | Base oil 4 | Base oil 5 | Base oil 6 |
|---|---|---|---|---|
| Acyclic saturated compounds (based on total acyclic saturated portion) | Normal paraffins, % by mass | 0 | 0.2 | 0.2 |
| | Isoparaffins, % by mass | 100 | 99.8 | 99.8 |
| Sulfur content, ppm by mass. | | <10 | <1 | <1 |
| Nitrogen content, ppm by mass. | | <3 | <1 | <3 |
| Kinematic viscosity (40° C.), $mm^2/s$ | | 9.88 | 13.48 | 19.91 |
| Kinematic viscosity (100° C.), $mm^2/s$ | | 2.79 | 3.272 | 4.302 |
| Viscosity index | | 130 | 111 | 125 |
| Density (15° C.), $g/cm^3$ | | 0.8092 | 0.8319 | 0.8351 |
| Pour point, ° C. | | −35 | −22.5 | −17.5 |
| Freezing point, ° C. | | −37 | −25 | −20 |
| Iodine value | | 0.08 | 0.18 | 0.05 |
| Aniline point, ° C. | | 113.1 | 108.9 | 116.0 |
| Distillation properties, ° C. | IBP, ° C. | 311 | 243 | 325 |
| | T10, ° C. | 350 | 312 | 383 |
| | T50, ° C. | 382 | 377 | 420 |
| | T90, ° C. | 405 | 418 | 457 |
| | FBP, ° C. | 423 | 493 | 495 |
| CCS viscosity (−35° C.), mPa · s | | 1,610 | 770 | 3,000 |
| MRV viscosity (−40° C.), mPa · s | 0.3% by mass Pour point depressant | <5,000 | — | 13,200 |
| | 0.5% by mass Pour point depressant | <5,000 | — | 14,300 |
| | 1.0% by mass Pour point depressant | <5,000 | — | 14,000 |

Examples 2-1 to 2-5

Comparative Example 2-1

For Examples 2-1 to 2-5 and Comparative Example 2-1 there were prepared lubricating oil compositions having the compositions shown in Table 8, using base oils 1 to 5 mentioned above and the additives listed below. The conditions for preparation of each lubricating oil composition were for a HTHS viscosity at 150° C. in the range of 2.55-2.65. The properties of the obtained lubricating oil compositions are shown in Table 8.

(Additives)

PK: Additive package (containing metallic detergent (Ca salicylate, Ca: 2000 ppm), ash-free dispersant (borated polybutenylsuccinic acid imide), antioxidants (phenol-based, amine-based), anti-wear agent (zinc alkylphosphate, P: 800 ppm), ester-based ash-free friction modifier, urea-based ash-free friction modifier, pour point depressant, antifoaming agent and other components).

MoDTC: Molybdenum dithiocarbamate

VM-1: Non-dispersant polymethacrylate (Copolymer obtained by polymerizing 90 mol % of an alkyl methacrylate mixture (alkyl groups: methyl, C12-15 straight-chain alkyl and C16-20 straight-chain alkyl groups) and 10 mol % of an alkyl methacrylate with a $C_{2-2}$ branched alkyl group, as the main structural units), M1 =0.60, M2 =0.95, M1/M2 =0.64, PSSI=20, MW=400,000, Mw/PSSI=$2\times10^4$, Mw/Mn=2.2, ΔKV40/ΔKV100 =2.2, ΔHTHS100/ΔHTHS150 =1.51. VM-2: Non-dispersant polymethacrylate (Copolymer obtained by polymerizing dimethylaminoethyl methacrylate and an alkyl methacrylate mixture (alkyl groups: methyl and C12-15 straight-chain alkyl groups) as the main structural units), M1 =0.46, M2 =3.52, M1/M2 =0.13, PSSI=40, MW=300,000, Mw/PSSI=$0.75\times10^4$, Mw/Mn=4.0, ΔKV40/ΔKV100 =3.3, ΔHTHS100/ΔHTHS150 =1.79.

[Evaluation of Lubricating Oil Composition]

Each of the lubricating oil compositions of Examples 2-1 to 2-5 and Comparative Example 2-1 was measured for 40° C. or kinematic viscosity at 100° C., viscosity index, NOACK evaporation (1 h, 250° C.), 150° C. and HTHS viscosity at 100° C., −35° C. CCS viscosity and −40° C. MR viscosity. The physical property values were measured by the following evaluation methods. The results are shown in Table 8.

(1) Kinematic viscosity: ASTM D-445
(2) HTHS viscosity: ASTM D4683
(3) NOACK evaporation: ASTM D 5800
(4) CCS viscosity: ASTM D5293
(5) MR viscosity: ASTM D3829

TABLE 8

| Base oil (based on total base oil) | | | Example 2-1 | Example 2-2 | Example 2-3 | Comp. Ex. 2-1 | Example 2-4 | Example 2-5 |
|---|---|---|---|---|---|---|---|---|
| First lubricating base oil component | Base oil 1 | outmass % | | 72 | | | | |
| | Base oil 2 | outmass % | 72 | | | 72 | 100 | |
| | Base oil 3 | outmass % | | | 72 | | | |
| Second lubricating base oil component | Base oil 4 | outmass % | 28 | 28 | 28 | 28 | | |
| Other | Base oil 5 | outmass % | | | | | | 12 |
| | Base oil 6 | outmass % | | | | | | 88 |

TABLE 8-continued

| Base oil (based on total base oil) | | | | Example 2-1 | Example 2-2 | Example 2-3 | Comp. Ex. 2-1 | Example 2-4 | Example 2-5 |
|---|---|---|---|---|---|---|---|---|---|
| Base oil properties | Kinematic viscosity | 40° C. | $mm^2/s$ | 13.22 | 13.74 | 13.82 | 13.22 | 15.80 | 16.68 |
| | | 100° C. | $mm^2/s$ | 3.412 | 3.500 | 3.530 | 3.412 | 3.867 | 3.822 |
| | Viscosity index | | | 138 | 138 | 140 | 138 | 143 | 122 |
| | NOACK | 1 h, 250° C. | mass % | 22.41 | 22.50 | 21.60 | 22.41 | 14.80 | 22.54 |
| Additive (Based on total composition) | VM-1 | | inmass % | 12.85 | 12.85 | 12.85 | | 11.78 | 10.00 |
| | VM-2 | | inmass % | | | | 7.21 | | |
| | PK | | inmass % | 10 | 10 | 10 | 10 | 10 | 10 |
| | MoDTC | | inmass % | 0.69 | 0.69 | 0.69 | 0.69 | 0.69 | 0.69 |
| Properties | Kinematic viscosity | 40° C. | $mm^2/s$ | 26.69 | 27.08 | 27.11 | 34.21 | 28.84 | 31.12 |
| | | 100° C. | $mm^2/s$ | 7.49 | 7.52 | 7.56 | 9.08 | 7.48 | 7.52 |
| | Viscosity index | | | 272 | 269 | 271 | 264 | 234 | 224 |
| | NOACK | 1 h, 250° C. | mass % | 18 | 18 | 18 | 19 | 12 | 18 |
| | HTHS viscosity | 100° C. | mPa · s | 4.39 | 4.41 | 4.38 | 4.98 | 4.52 | 4.72 |
| | | 150° C. | mPa · s | 2.60 | 2.60 | 2.60 | 2.60 | 2.60 | 2.59 |
| | CCS viscosity | −35° C. | mPa · s | 2000 | 2100 | 2200 | 2300 | 2700 | 5000 |
| | MRV viscosity | −40° C. | mPa · s | 4100 | 4300 | 4500 | 5700 | 8700 | 20600 |

The invention claimed is:

1. A lubricating oil composition comprising:

a lubricating base oil with a kinematic viscosity at 100° C. of 1-20 $mm^2/s$, and a viscosity index improver having a ratio M1/M2 of 0.20 or greater, between the total area of the peaks between chemical shifts of 36-38 ppm M1 and the total area of the peaks between chemical shifts of 64-66 ppm M2, with respect to the total area of all of the peaks, in the spectrum obtained by $^{13}C$-NMR wherein the lubricating base oil comprises a first lubricating base oil component having a urea adduct value of no greater than 5% by mass, a kinetic viscosity at 40° C. of at least 14 $mm^2/s$; and no greater than 25 $mm^2/s$, and a viscosity index of 120 or greater; and a second lubricating base oil component having a kinematic viscosity at 40° C. of 5 $mm^2/s$ or greater and less than 14 $mm^2/s$: and wherein the content of the first lubricating base oil component is 10-99% by mass and the content of the second lubricating base oil component is 1-50% by mass, based on the total weight of the lubricating oil.

2. A lubricating oil composition according to claim 1, wherein, the lubricating base oil has, as distillation properties, an initial boiling point of no higher than 370° C., a 90% distillation temperature of 430° C. or higher, and a difference between the 90% distillation temperature and 10% distillation temperature of at least 50° C.

3. A lubricating oil composition according to claim 1, wherein the viscosity index improver is a poly(meth)acrylate-based viscosity index improver.

4. A lubricating oil composition according to claim 1, wherein the viscosity index improver has a PSSI of no greater than 40 and a weight-average molecular weight/PSSI ratio of at least $1\times10^4$.

5. A lubricating oil composition according to claim 1, further comprising a poly(meth)acrylate with a weight-average molecular weight of no greater than 100,000.

6. A lubricating oil composition according to claim 1, further comprising at least one compound selected from among organic molybdenum compounds and ash-free friction modifiers.

7. A lubricating oil composition according to claim 1, wherein the ratio of the HTHS viscosity at 100° C. with respect to the HTHS viscosity at 150° C. of the lubricating oil composition satisfies the condition represented by the following inequality (A):

$$\text{HTHS}(100°\text{ C.})/\text{HTHS}(150°\text{ C.})\leq 2.04 \quad (A)$$

wherein HTHS (100° C.) represents the HTHS viscosity at 100° C. and HTHS (150° C.) represents the HTHS viscosity at 150° C.

8. A method for producing a lubricating oil composition, in which:

a first lubricating base oil component having a urea adduct value of no greater than 5% by mass, a kinematic viscosity at 40° C. of at least 14 $mm^2/s$ and no greater than 25 $mm^2/s$ and a viscosity index of 120 or greater, a second lubricating base oil component having a kinematic viscosity at 40° C. of 5 $mm^2/s$ or greater and less than 14 $mm^2/s$, and a viscosity index improver having a ratio M1/M2 of 0.20 or greater, between the total area of the peaks between chemical shifts of 36-38 ppm M1 and the total area of the peaks between chemical shifts of 64-66 ppm M2, with respect to the total area of all of the peaks in the spectrum obtained by $^{13}C$-NMR, are combined to obtain a lubricating oil composition having a first lubricating base oil component content of 10-99% by mass and a second lubricating base oil component content of 1-50% by mass, based on the total weight of the lubricating base oil, and a kinematic viscosity at 100° C. of 4-12 $mm^2/s$ and a viscosity index of 200-350.

* * * * *

UNITED STATES PATENT AND TRADEMARK OFFICE

CERTIFICATE OF CORRECTION

PATENT NO. : 8,999,904 B2
APPLICATION NO. : 13/375365
DATED : April 7, 2015
INVENTOR(S) : S. Matsui et al.

It is certified that error appears in the above-identified patent and that said Letters Patent is hereby corrected as shown below:

On the Title page/item (56) Other Publications, page 3, column 1, line 9, please change "Machinery Lubirication" to -- Machinery Lubrication --
On the Title page/item (56) Other Publications, page 4, column 2, line 46, please change "for Inproving" to -- for Improving --

In the Claims

Column 39, line 38 please change "a kinetic" to -- a kinematic --
Column 39, line 39 please change "14 $mm^2/s$; and" to -- 14 $mm^2/s$ and --
Column 39, line 42 please change "14 $mm^2/s$: and" to -- 14 $mm^2/s$; and --

Signed and Sealed this
Twenty-second Day of September, 2015

Michelle K. Lee

Michelle K. Lee
*Director of the United States Patent and Trademark Office*